US007205266B2

(12) United States Patent
Holderbaum et al.

(10) Patent No.: US 7,205,266 B2
(45) Date of Patent: Apr. 17, 2007

(54) LAUNDRY OR DISHWASHER DETERGENT TABLET HAVING AT LEAST ONE CAVITY

(75) Inventors: Thomas Holderbaum, Monheim (DE); Bernd Richter, Leichlingen (DE); Christian Nitsch, Duesseldorf (DE); Rolf Bayersdoerfer, Duesseldorf (DE)

(73) Assignee: Henkel KGaA, Duesseldorf (DE)

( * ) Notice: Subject to any disclaimer, the term of this patent is extended or adjusted under 35 U.S.C. 154(b) by 75 days.

(21) Appl. No.: 10/381,611

(22) PCT Filed: Sep. 19, 2001

(86) PCT No.: PCT/EP01/10807

§ 371 (c)(1),
(2), (4) Date: Mar. 26, 2003

(87) PCT Pub. No.: WO02/26926

PCT Pub. Date: Apr. 4, 2002

(65) Prior Publication Data

US 2003/0186828 A1 Oct. 2, 2003

(30) Foreign Application Priority Data

Sep. 28, 2000 (DE) ..... 100 48 058
Feb. 20, 2001 (DE) ..... 101 08 153

(51) Int. Cl.
*C11D 17/00* (2006.01)
*C11D 3/37* (2006.01)

(52) U.S. Cl. ..... 510/224; 510/294; 510/298; 510/356; 510/446; 510/475

(58) Field of Classification Search ..... 510/224, 510/294, 298, 356, 446, 475
See application file for complete search history.

(56) References Cited

U.S. PATENT DOCUMENTS

| | | | | |
|---|---|---|---|---|
| 3,234,258 | A | 2/1966 | Morris | |
| 4,898,621 | A | 2/1990 | Pruehs et al. | |
| 5,075,041 | A | 12/1991 | Lutz | |
| 5,958,855 | A * | 9/1999 | Binstock et al. | 510/224 |
| 6,274,538 | B1 * | 8/2001 | Addison | 510/224 |
| 6,306,814 | B1 * | 10/2001 | Appel et al. | 510/446 |
| 6,391,845 | B1 * | 5/2002 | Speed et al. | 510/446 |
| 6,486,117 | B1 * | 11/2002 | Painter et al. | 510/446 |
| 6,544,943 | B1 * | 4/2003 | Ricci et al. | 510/446 |
| 6,544,944 | B1 * | 4/2003 | Ricci et al. | 510/446 |
| 6,548,473 | B1 * | 4/2003 | Jacques Kamiel Thoen et al. | 510/446 |
| 6,551,982 | B1 * | 4/2003 | Ricci et al. | 510/446 |
| 6,589,932 | B1 * | 7/2003 | Ricci et al. | 510/446 |
| 6,686,328 | B1 * | 2/2004 | Binder | 510/446 |
| 6,770,616 | B1 * | 8/2004 | McGowan et al. | 510/446 |
| 6,800,598 | B1 * | 10/2004 | Waeschenbach et al. | 510/224 |
| 2002/0147125 | A1 | 10/2002 | Hoflinger et al. | |

FOREIGN PATENT DOCUMENTS

| | | | |
|---|---|---|---|
| DE | 199 22 578 | A1 | 11/2000 |
| EP | 0 300 305 | | 2/1993 |
| EP | 0 979 865 | A1 | 2/2000 |
| JP | 09175992 | A2 * | 7/1997 |
| WO | WO 99/24548 | A1 | 5/1999 |
| WO | WO 99/24548 | A1 * | 5/1999 |
| WO | WO 99/27063 | A1 | 6/1999 |
| WO | WO 00/42148 | A1 | 7/2000 |
| WO | WO 00/44869 | A1 | 8/2000 |

OTHER PUBLICATIONS

Donald W. Breck, "Zeolite Molecular Sieves", John Wiley & Sons, New York, London, Sydney, Toronto, pp. 92, 145, 176, 177 (1974).
CFTA International Cosmetic Ingredient Dictionary and Handbook, 5th Edition, The Cosmetic, Toiletry and Fragrance Association, Washington (1993).
"Determination of the water vapour transmission rate of plastic film, rubber sheeting, paper, board and other sheet materials by gravimetry," DIN 53 122-1 pp. 1-7, DIN Deutches Institut für Normung e.V., Berlin, Germany, (Aug. 2001).
"Standard Test Methods for Water Vapor Transmission of Materials," ASTM E-96-53T, Annual Book of ASTM Standards, vol. 14.02, pp. 1-8, ASTM International, (2000).
Hans Dominghaus, "Die Kunststoffe und Ihre Eigenschaften", 3rd Edition, VDI Verlag, Dusseldorf, p. 193 (1988).

* cited by examiner

*Primary Examiner*—Lorna M. Douyon
(74) *Attorney, Agent, or Firm*—John S. Child, Jr.

(57) ABSTRACT

Laundry or dishwasher detergent tablets comprise at least one cavity, nonionic surfactants in the range from 5 to 25% by weight, based on the tablet and 0.1% to 70% by weight of sulfonated copolymers.

53 Claims, No Drawings

LAUNDRY OR DISHWASHER DETERGENT TABLET HAVING AT LEAST ONE CAVITY

CROSS-REFERENCE TO RELATED APPLICATIONS

This application is a U.S. National Stage application filed under 35 U.S.C. § 371, claiming priority under 35 U.S.C. § 365 of International Application No. PCT/EP01/10807, filed Sep. 19, 2001 in the European Patent Office, and claiming priority under 35 U.S.C. § 119 of DE 100 48 058.6, filed Sep. 28, 2000 and DE 101 08 153.7, filed Feb. 20, 2001, in the German Patent Office.

BACKGROUND OF THE INVENTION

This invention relates to laundry or dishwasher detergent tablets in the form of cavity tablets, i.e. tablets which have at least one cavity in one of their surfaces. The invention also relates to a process for the production of cavity tablets (or "tabs"). In this process, a cavity is punched into one (generally the upper) side of a large-volume tablet and, in a following process step, may be filled with another material, more particularly by pouring.

The production of cavity tablets involves particular problems because the surface of the tablet is profiled rather than flat. This gives rise to different compression and abrasion conditions for the various surface geometries of the corresponding punch. Since the tendency of substances to be tabletted to adhere to the punch is dependent inter alia on the specific surface pressure and the pressure vectors determined by the surface geometry, certain parts of a punch profile show a particular tendency towards adhesion or caking. After numerous tabletting cycles, such adhesion results in increasing roughness of the tablet surfaces at the corresponding places which can lead to deviations in the quantities of the substances and in addition to tablet breakage. If a tablet breaks in the tabletting press, the production process is seriously disrupted.

One way of solving this problem is to select the geometry of the cavity so that caking and edge breakage at the margins of the cavity are avoided. However, the possibilities for variation are often seriously limited from the technical perspective (for example cavity volume for given tablet dimensions) or the aesthetic perspective. Surface treatment of the punch with anti-adhesion materials can also be used to reduce the tendency towards adhesion. However, the materials known from the prior art are attended by the disadvantage of short useful lives so that the tools have to be changed at frequent intervals. The technical problem addressed by the present invention was to formulate the mixture to be tabletted in such a way—by adding certain substances—that adhesion to the punch and breakages at the edges of the cavity could be reduced or avoided altogether. According to the invention, the solution to this problem is characterized in that nonionic surfactants and, in particular, nonionic surfactant mixtures are used in certain quantity ranges in the mixtures to be tabletted. In the case of multiphase (particularly multilayer) tablets, a corresponding addition to the mixture forming the phase which comes into contact during final pressing with the punch forming the cavity in the tablets is sufficient.

DESCRIPTION OF THE INVENTION

The present invention relates to laundry or dishwasher detergent tablets comprising at least one cavity, characterized in that they have a nonionic surfactant content of 5 to 25% by weight, based on the tablet.

The use of nonionic surfactants in the quantities mentioned leads to a reduction in adhesion to the non-planar punch surface and to a distinct reduction in breakages at the edges of the cavity. In the case of multiphase tablets, a corresponding composition of the phase with the cavity, i.e. the premix which comes into contact with the non-planar punch surface during final pressing, is sufficient. Since the first premix is only lightly compressed by the punch in pre-compression steps (for example in the production of two-layer tablets), no adhesion or edge breakages occur(s). Only during final pressing do the forces become so great that the problems mentioned are in danger of arising.

Accordingly, the present invention also relates to multiphase laundry or dishwasher detergent tablets comprising at least one cavity, the phase with the cavity having a nonionic surfactant content of 5 to 25% by weight.

In a tabletting process, it is of course only possible to produce a shaped body which has vertical lateral boundary surfaces (possibility of ejection from the cavity block).The bottom surface and "cover" surface are normally horizontal, i.e. they and the edge(s) are orthogonal to one another. Tablets with at least one cavity (so-called cavity tablets) have this cavity in their upper or lower face for the reasons mentioned above. In order to simplify ejection from the cavity block, the bottom punch (and hence the lower face) is generally flat while the top punch has at least one protuberance which punches the cavity into the upper face of the tablet. The tablets according to the invention (hereinafter also referred to as the "basic tablets") may assume any geometric form, concave, convex, biconcave, biconvex, cubic, tetragonal, orthorhombic, cylindrical, spherical, cylinder-segment-like, disk-shaped, tetrahedral, dodecahedral, octahedral, conical, pyramidal, ellipsoidal, pentagonal-, heptagonal- and hexagonal-prismatic and rhombohedral forms being particularly preferred. Completely irregular bases, such as arrow and animal shapes, trees, clouds etc. can also be produced. If the basic tablets have corners and edges, they are preferably rounded off. As an additional optical differentiation, an embodiment with rounded-off corners and bevelled ("chamfered") edges is preferred.

The shape of the cavity may also be freely selected, preferred tablets being characterized in that at least one cavity may assume a concave, convex, cubic, tetragonal, orthorhombic, cylindrical, spherical, cylinder-segment-like, disk-shaped, tetrahedral, dodecahedral, octahedral, conical, pyramidal, ellipsoidal, pentagonal-, heptagonal- and hexagonal-prismatic and rhombohedral form. The cavity may also assume completely irregular shapes, such as arrow or animal shapes, trees, clouds, etc. As with the basic tablets, cavities with rounded-off corners and edges or rounded-off corners and chamfered edges are preferred.

The problem of tablet breakages at the edges of the cavity and adhesion to the projections of the punch occurs to a greater extent when the rim angle of the cavity increases. On the other hand, a rim angle approaching 90° is preferred because flat cavities only have small volumes whereas "steep" cavities can have large volumes for a small opening area. The solution according to the invention is particularly appropriate in such problem cases. Corresponding laundry or dishwasher detergent tablets which are characterized in that the cavity has lateral boundary walls that are orthogonal to its base represent preferred embodiments.

Between the extremes of a hemispherical or semi-ellipsoidal cavity (no straight lateral boundary surfaces) or a cylindrical cavity (straight lateral boundary surfaces which converge orthogonally onto a cavity base running parallel to the bottom surface), various transitions are possible. Generally, the problems arise to a greater extent if the lateral boundary surfaces are straight, i.e. when the shortest connecting line from the edge to the base of the cavity is a straight line and not a curve. Since the advantages according to the invention become clearer in this case, corresponding tablets according to the invention are preferred. With the straight lateral boundary walls, the problems again stand out more clearly, the steeper those walls are (see above) which, in the extreme case, leads to the above-mentioned angles of 90° (angles of <90° between the bottom of the cavity and the lateral boundary line are technically not possible because otherwise the base of the cavity would be larger than its opening area). The advantages according to the invention stand out most clearly in this extreme case. However, cavities with "straight" side walls and non-orthogonal angles—which is technically preferred—can also be produced. Cavities such as these, which comprise a cone, have advantages in subsequent filling processes so that preferred tablets according to the invention are those where the angle explained above is between 90 and 120°, preferably between 91 and 110°, more preferably between 92 and 100° and most preferably between 93 and 98°.

The size of the cavity by comparison with the tablet as a whole is determined by the application envisaged for the tablet. The size of the cavity can vary according to whether and with what substances in what aggregate states the cavity is to be filled. Irrespective of the intended application, preferred laundry and dishwasher detergent tablets are characterized in that the ratio by volume of the basic tablet to the cavity volume is in the range from 1:1 to 100:1, preferably in the range from 2:1 to 80:1, more preferably in the range from 3:1 to 50:1 and most preferably in the range from 4:1 to 30:1.

Similar observations may be made on the contributions made by the basic tablet or the cavity opening to the total surface area of the tablet. In preferred laundry or dishwasher detergent tablets, the surface area of the cavity opening makes up 1 to 25%, preferably 2 to 20%, more preferably 3 to 15% and most preferably 4 to 10% of the total surface area of the tablet.

If, for example, the tablet as a whole has dimensions of 20×20×40 mm and, hence, a total surface area of 40 $cm^2$, preferred cavity fillings have a surface area of 0.4 to 10 $cm^2$, preferably 0.8 to 8 $cm^2$, more preferably 1.2 to 6 $cm^2$ and most preferably 1.6 to 4 $cm^2$.

The cavity tablets according to the invention contain nonionic surfactant(s). In addition, they may contain (particularly in the case of laundry detergent tablets) anionic, cationic and/or amphoteric surfactants or mixtures thereof. Mixtures of anionic and nonionic surfactants are preferred for laundry detergent tablets from the performance perspective. The total surfactant content of laundry detergent tablets is in the range from 5 to 60% by weight, based on tablet weight, surfactant contents in excess of 15% by weight being preferred.

The anionic surfactants used are, for example, those of the sulfonate and sulfate type. Preferred surfactants of the sulfonate type are $C_{9-13}$ alkyl benzenesulfonates, olefin sulfonates, i.e. mixtures of alkene and hydroxy-alkane sulfonates, and the disulfonates obtained, for example, from $C_{12-18}$ monoolefins with an internal or terminal double bond by sulfonation with gaseous sulfur trioxide and subsequent alkaline or acidic hydrolysis of the sulfonation products. Other suitable surfactants of the sulfonate type are the alkane sulfonates obtained from $C_{12-18}$ alkanes, for example by sulfochlorination or sulfoxidation and subsequent hydrolysis or neutralization. The esters of α-sulfofatty acids (ester sulfonates), for example the α-sulfonated methyl esters of hydrogenated coconut, palm kernel or tallow fatty acids, are also suitable.

Other suitable anionic surfactants are sulfonated fatty acid glycerol esters, i.e. the monoesters, diesters and triesters and mixtures thereof which are obtained where production is carried out by esterification of a monoglycerol with 1 to 3 mol of fatty acid or in the transesterification of triglycerides with 0.3 to 2 mol of glycerol. Preferred sulfonated fatty acid glycerol esters are the sulfonation products of saturated $C_{6-22}$ fatty acids, for example caproic acid, caprylic acid, capric acid, myristic acid, lauric acid, palmitic acid, stearic acid or behenic acid.

Preferred alk(en)yl sulfates are the alkali metal salts and, in particular, the sodium salts of the sulfuric acid semiesters of $C_{12-18}$ fatty alcohols, for example coconut alcohol, tallow alcohol, lauryl, myristyl, cetyl or stearyl alcohol, or $C_{10-20}$ oxoalcohols and the corresponding semiesters of secondary alcohols with the same chain length. Other preferred alk(en)yl sulfates are those with the chain length mentioned which contain a synthetic, linear alkyl chain based on a petrochemical and which are similar in their degradation behavior to the corresponding compounds based on oleochemical raw materials. $C_{12-16}$ alkyl sulfates and $C_{12-15}$ alkyl sulfates and also $C_{14-15}$ alkyl sulfates are particularly preferred from the washing performance point of view. Other suitable anionic surfactants are 2,3-alkyl sulfates which may be produced, for example, in accordance with U.S. Pat. No. 3,234,258 or U.S. Pat. No. 5,075,041 and which are commercially obtainable as products of the Shell Oil Company under the name of DAN®.

The sulfuric acid monoesters of linear or branched $C_{7-21}$ alcohols ethoxylated with 1 to 6 mol of ethylene oxide, such as 2-methyl-branched $C_{9-11}$ alcohols containing on average 3.5 mol of ethylene oxide (EO) or $C_{12-18}$ fatty alcohols containing 1 to 4 EO, are also suitable. In view of their high foaming capacity, they are normally used in only relatively small quantities, for example in quantities of 1 to 5% by weight, in dishwashing detergents.

Other suitable anionic surfactants are the salts of alkyl sulfosuccinic acid which are also known as sulfosuccinates or as sulfosuccinic acid esters and which represent monoesters and/or diesters of sulfosuccinic acid with alcohols, preferably fatty alcohols and, more particularly, ethoxylated fatty alcohols. Preferred sulfosuccinates contain $C_{8-18}$ fatty alcohol molecules or mixtures thereof. Particularly preferred sulfosuccinates contain a fatty alcohol molecule derived from ethoxylated fatty alcohols which, considered in isolation, represent nonionic surfactants (for a description, see below). Of these sulfosuccinates, those of which the fatty alcohol molecules are derived from narrow-range ethoxylated fatty alcohols are particularly preferred. Alk(en)yl succinic acid preferably containing 8 to 18 carbon atoms in the alk(en)yl chain or salts thereof may also be used.

Other suitable anionic surfactants are, in particular, soaps. Suitable soaps are, in particular, saturated fatty acid soaps, such as the salts of lauric acid, myristic acid, palmitic acid, stearic acid, hydrogenated erucic acid and behenic acid, and soap mixtures derived in particular from natural fatty acids, for example coconut, palm kernel or tallow acids.

The anionic surfactants, including the soaps, may be present in the form of their sodium, potassium or ammonium salts and as soluble salts of organic bases, such as mono-, di- or triethanolamine. The anionic surfactants are preferably present in the form of their sodium or potassium salts and, more preferably, in the form of their sodium salts.

In dishwasher detergents, only low-foaming nonionic surfactants are normally used as surfactants. Accordingly, representatives from the groups of anionic, cationic or amphoteric surfactants are of relatively little importance to the dishwasher tablets according to the invention. The nonionic surfactants which, according to the invention, are present in quantities of 5 to 25% by weight both in the dishwasher tablets and in laundry detergent tablets are described in the following.

In particularly preferred embodiments of the present invention, the laundry or dishwasher detergent tablets according to the invention contain nonionic surfactants from the group of alkoxylated alcohols. Preferred nonionic surfactants are alkoxylated, advantageously ethoxylated, more especially primary alcohols preferably containing 8 to 18 carbon atoms and, on average, 1 to 12 mol of ethylene oxide (EO) per mol of alcohol, in which the alcohol group may be linear or, preferably, methyl-branched in the 2-position or may contain linear and methyl-branched groups in the form of the mixtures typically present in oxoalcohol groups. However, alcohol ethoxylates containing linear groups of alcohols of native origin with 12 to 18 carbon atoms, for example coconut, palm, tallow or oleyl alcohol, and on average 2 to 8 EO per mol of alcohol are particularly preferred. Preferred ethoxylated alcohols include, for example, $C_{12-14}$ alcohols containing 3 EO or 4 EO, $C_{9-11}$ alcohol containing 7 EO, $C_{13-15}$ alcohols containing 3 EO, 5 EO, 7 EO or 8 EO, $C_{12-18}$ alcohols containing 3 EO, 5 EO or 7 EO and mixtures thereof, such as mixtures of $C_{12-14}$ alcohol containing 3 EO and $C_{12-18}$ alcohol containing 5 EO. The degrees of ethoxylation mentioned represent statistical mean values which, for a special product, can be a whole number or a broken number. Preferred alcohol ethoxylates have a narrow homolog distribution (narrow range ethoxylates, NRE). In addition to these nonionic surfactants, fatty alcohols containing more than 12 EO may also be used, examples including tallow fatty alcohol containing 14 EO, 25 EO, 30 EO or 40 EO.

Suitable other nonionic surfactants are alkyl glycosides with the general formula $RO(G)_x$ where R is a primary, linear or methyl-branched, more particularly 2-methyl-branched, aliphatic radical containing 8 to 22 and preferably 12 to 18 carbon atoms and G stands for a glycose unit containing 5 or 6 carbon atoms, preferably glucose. The degree of oligomerization x, which indicates the distribution of monoglycosides and oligoglycosides, is a number of 1 to 10 and preferably 1.2 to 1.4.

Another class of preferred nonionic surfactants which may be used either as sole nonionic surfactant or in combination with other nonionic surfactants are alkoxylated, preferably ethoxylated or ethoxylated and propoxylated, fatty acid alkyl esters preferably containing 1 to 4 carbon atoms in the alkyl chain, more especially fatty acid methyl esters.

Nonionic surfactants of the amine oxide type, for example N-coconutalkyl-N,N-dimethylamine oxide and N-tallowalkyl-N,N-dihydroxy-ethylamine oxide, and the fatty acid alkanolamide type are also suitable. The quantity in which these nonionic surfactants are used is preferably no more than the quantity in which the ethoxylated fatty alcohols are used and, more preferably, no more than half that quantity.

Other suitable surfactants are polyhydroxyfatty acid amides corresponding to formula (I):

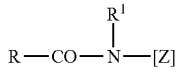

(I)

in which RCO is an aliphatic acyl group containing 6 to 22 carbon atoms, $R^1$ is hydrogen, an alkyl or hydroxyalkyl group containing 1 to 4 carbon atoms and [Z] is a linear or branched polyhydroxyalkyl group containing 3 to 10 carbon atoms and 3 to 10 hydroxyl groups. The polyhydroxyfatty acid amides are known substances which may normally be obtained by reductive amination of a reducing sugar with ammonia, an alkylamine or an alkanolamine and subsequent acylation with a fatty acid, a fatty acid alkyl ester or a fatty acid chloride.

The group of polyhydroxyfatty acid amides also includes compounds corresponding to formula (II):

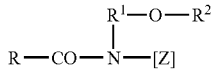

(II)

in which R is a linear or branched alkyl or alkenyl group containing 7 to 12 carbon atoms, $R^1$ is a linear, branched or cyclic alkyl group or an aryl group containing 2 to 8 carbon atoms and $R^2$ is a linear, branched or cyclic alkyl group or an aryl group or an oxyalkyl group containing 1 to 8 carbon atoms, $C_{1-4}$ alkyl or phenyl groups being preferred, and [Z] is a linear polyhydroxy-alkyl group, of which the alkyl chain is substituted by at least two hydroxyl groups, or alkoxylated, preferably ethoxylated or propoxylated, derivatives of that group.

[Z] is preferably obtained by reductive amination of a reduced sugar, for example glucose, fructose, maltose, lactose, galactose, mannose or xylose. The N-alkoxy- or N-aryloxy-substituted compounds may then be converted into the required polyhydroxyfatty acid amides by reaction with fatty acid methyl esters in the presence of an alkoxide as catalyst.

In a particularly preferred embodiment, dishwasher tablets according to the invention contain a nonionic surfactant which has a melting point above room temperature. Accordingly, preferred laundry or dishwasher detergent tablets are characterized in that they contain nonionic surfactant(s) with a melting point above 20° C., preferably above 25° C., more preferably between 25 and 60° C. and most preferably between 26.6 and 43.3° C. in quantities of 5.5 to 20% by weight, preferably 6.0 to 17.5% by weight, more preferably 6.5 to 15% by weight and most preferably 7.0 to 12.5% by weight, based on the tablet or the phase which has the cavity.

Suitable nonionic surfactants with melting or softening points in the temperature range mentioned above are, for example, low-foaming nonionic surfactants which may be solid or highly viscous at room temperature. If nonionic surfactants highly viscous at room temperature are used, they preferably have a viscosity above 20 Pas, more preferably above 35 Pas and most preferably above 40 Pas. Nonionic surfactants which are wax-like in consistency at room temperature are also preferred.

Preferred nonionic surfactants solid at room temperature belong the groups of alkoxylated nonionic surfactants, more particularly ethoxylated primary alcohols, and mixtures of these surfactants with structurally complex surfactants, such as polyoxypropylene/polyoxyethylene/polyoxypropylene (PO/EO/PO) surfactants. In addition, (PO/EO/PO) nonionic surfactants are distinguished by good foam control.

In one preferred embodiment of the present invention, the nonionic surfactant with a melting point above room temperature is an ethoxylated nonionic surfactant emanating from the reaction of a monohydroxyalkanol or alkylphenol containing 6 to 20 carbon atoms with preferably at least 12 mol, more preferably at least 15 mol and most preferably at least 20 mol ethylene oxide per mol alcohol or alkylphenol. Accordingly, corresponding detergent tablets which are characterized in that the nonionic surfactant(s) is/are ethoxylated nonionic surfactant(s) obtained from $C_{6-20}$ monohydroxyalkanols or $C_{6-20}$ alkylphenols or $C_{16-20}$ fatty alcohols and more than 12 mol, preferably more than 15 mol and more particularly more than 20 mol ethylene oxide per mol alcohol are preferred.

A particularly preferred nonionic surfactant solid at room temperature is obtained from a straight-chain fatty alcohol containing 16 to 20 carbon atoms ($C_{16-20}$ alcohol), preferably a $C_{18}$ alcohol, and at least 12 mol, preferably at least 15 mol and more preferably at least 20 mol of ethylene oxide. Of these nonionic surfactants, the so-called narrow range ethoxylates (see above) are particularly preferred.

The nonionic surfactant solid at room temperature preferably also contains propylene oxide units in the molecule. These PO units preferably make up as much as 25% by weight, more preferably as much as 20% by weight and, most preferably, up to 15% by weight of the total molecular weight of the nonionic surfactant. Laundry or dishwasher detergent tablets containing ethoxylated and propoxylated nonionic surfactants where the propylene oxide units make up as much as 25% by weight, preferably as much as 20% by weight and, more particularly, up to 15% by weight of the total molecular weight of the nonionic surfactant represent preferred embodiments of the present invention. Particularly preferred nonionic surfactants are ethoxylated monohydroxyalkanols or alkylphenols which additionally contain polyoxyethylene/polyoxypropylene block copolymer units. The alcohol or alkylphenol component of these nonionic surfactant molecules preferably makes up more than 30% by weight, more preferably more than 50% by weight and most preferably more than 70% by weight of the total molecular weight of these nonionic surfactants.

Other particularly preferred nonionic surfactants with melting points above room temperature contain 40 to 70% of a polyoxypropylene/polyoxyethylene/polyoxpropylene block polymer blend which contains 75% by weight of an inverted block copolymer of polyoxyethylene and polyoxypropylene with 17 mol ethylene oxide and 44 mol propylene oxide and 25% by weight of a block copolymer of polyoxyethylene and polyoxypropylene initiated with trimethylol propane and containing 24 mol ethylene oxide and 99 mol propylene oxide per mole of trimethylol propane.

Nonionic surfactants which may be used with particular advantage are obtainable, for example, under the name of Poly Tergent® SLF-18 from Olin Chemicals.

Another preferred surfactant may be described by the following formula:

$$R^1O[CH_2CH(CH_3)O]_x[CH_2CH_2O]_y[CH_2CH(OH)R^2]$$

in which $R^1$ is a linear or branched aliphatic hydrocarbon radical containing 4 to 18 carbon atoms or mixtures thereof, $R^2$ is a linear or branched hydrocarbon radical containing 2 to 26 carbon atoms or mixtures thereof, x has a value of 0.5 to 1.5 and y has a value of at least 15. Accordingly, laundry or dishwasher detergent tablets which are characterized in that they contain nonionic surfactants corresponding to the folowing formula:

$$R^1O[CH_2CH(CH_3)O]_x[CH_2CH_2O]_y[CH_2CH(OH)R^2]$$

in which $R^1$ is a linear or branched aliphatic hydrocarbon radical containing 4 to 18 carbon atoms or mixtures thereof, $R^2$ is a linear or branched hydrocarbon radical containing 2 to 26 carbon atoms or mixtures thereof, x has a value of 0.5 to 1.5 and y has a value of at least 15, are preferred.

Other preferred nonionic surfactants are the end-capped poly(oxyalkylated) nonionic surfactants corresponding to the following formula:

$$R^1O[CH_2CH(R^3)O]_x[CH_2]_kCH(OH)[CH_2]_jOR^2$$

in which $R^1$ and $R^2$ are linear or branched, saturated or unsaturated, aliphatic or aromatic hydrocarbon radicals containing 1 to 30 carbon atoms, $R^3$ stands for H or for a methyl, ethyl, n-propyl, isopropyl, n-butyl, 2-butyl or 2-methyl-2-butyl radical, x has a value of 1 to 30, k and j have values of 1 to 12 and preferably 1 to 5. Where x has a value of $\geqq 2$, each substituent $R^3$ in the above formula may be different. $R^1$ and $R^2$ are preferably linear or branched, saturated or unsaturated, aliphatic or aromatic hydrocarbon radicals containing 6 to 22 carbon atoms, radicals containing 8 to 18 carbon atoms being particularly preferred. For the substituent $R^3$, H, —$CH_3$ or —$CH_2CH_3$ are particularly preferred. Particularly preferred values for x are in the range from 1 to 20 and more particularly in the range from 6 to 15.

As mentioned above, each substituent $R^3$ in the above formula may be different where x is $\geqq 2$. In this way, the alkylene oxide unit in the square brackets can be varied. If, for example, x has a value of 3, the substituent $R^3$ may be selected to form ethylene oxide ($R^3$═H) or propylene oxide ($R^3$═$CH_3$) units which may be joined together in any order, for example (EO)(PO)(EO), (EO)(EO)(PO), (EO)(EO)(EO), (PO)(EO)(PO), (PO)(PO)(EO) and (PO)(PO)(PO). The value 3 for x was selected by way of example and may easily be larger, the range of variation increasing with increasing x-values and including, for example, a large number of (EO) groups combined with a small number of (PO) groups or vice versa.

Particularly preferred end-capped poly(oxyalkylated) alcohols corresponding to the above formula have values for both k and j of 1, so that the above formula can be simplified to:

$$R^1O[CH_2CH(R^3)O]_xCH_2CH(OH)CH_2OR^2$$

In this formula, $R^1$, $R^2$ and $R^3$ are as defined above and x has a value of 1 to 30, preferably 1 to 20 and more preferably 6 to 18. Surfactants in which the substituents $R^1$ and $R^2$ have 9 to 14 carbon atoms, $R^3$ stands for H and x has a value of 6 to 15 are particularly preferred.

To sum up, preferred laundry or dishwasher detergent tablets are characterized in that they, or the phase with the cavity, contain end-capped poly(oxyalkylated) nonionic surfactants corresponding to the following formula:

$$R^1O[CH_2CH(R^3)O]_x[CH_2]_kCH(OH)[CH_2]_jOR^2$$

in which $R^1$ and $R^2$ are linear or branched, saturated or unsaturated, aliphatic or aromatic hydrocarbon radicals containing 1 to 30 carbon atoms, $R^3$ stands for H or for a methyl, ethyl, n-propyl, isopropyl, n-butyl, 2-butyl or 2-methyl-2-butyl radical, x has a value of 1 to 30, k and j have values of 1 to 12 and preferably 1 to 5, surfactants of the following type:

$$R^1O[CH_2CH(R^3)O]_xCH_2CH(OH)CH_2OR^2$$

where x has a value of 1 to 30, preferably 1 to 20 and more preferably 6 to 18, being particularly preferred.

Mixtures of different nonionic surfactants are used with particular advantage in the tablets according to the invention. Particularly preferred laundry or dishwasher detergent tablets contain a) 1.0 to 4.0% by weight of nonionic surfactants from the group of alkoxylated alcohols, b) 4.0 to 24.0% by weight of nonionic surfactants from the group of hydroxyfunctional alkoxylated alcohols ("hydroxy mixed ethers"), based on the tablet as a whole or on the phase with the cavity.

The nonionic surfactants of group a) are described in detail in the foregoing, $C_{12-14}$ fatty alcohols containing 5EO and 4PO and $C_{12-18}$ fatty alcohols containing on average 9EO having proved to be particularly outstanding for machine dishwasher detergents containing the mixtures mentioned above. End-capped nonionic surfactants, more particularly $C_{12-18}$ fatty alcohol 9 EO butyl ether, may also be used with similar advantage.

Group b) surfactants have excellent "clear rinse" effects and reduce stress cracking in plastics. They also have the advantageous property that their wetting behavior remains constant over the entire usual temperature range. In a particularly preferred embodiment, the group b) surfactants are the hydroxyfunctional alkoxylated alcohols described in EP 300 305 of which the disclosure is specifically included in the present application. All the hydroxy mixed ethers disclosed there are, without exception, advantageously present as the group b) surfactant in the preferred dishwasher detergents according to the invention.

The quantities in which the surfactants of groups a) and b) may be present in preferred dishwasher tablets according to the invention vary according to the required product and preferably lie within relatively narrow ranges. Particularly preferred laundry or dishwasher detergent tablets contain a) 1.5 to 3.5% by weight, preferably 1.75 to 3.0% by weight and more particularly 2.0 to 2.5% by weight of nonionic surfactants from the group of alkoxylated alcohols, b) 4.5 to 20.0% by weight, preferably 5.0 to 15.0% by weight and more particularly 7.0 to 10.0% by weight of nonionic surfactants from the group of hydroxyfunctional alkoxylated alcohols ("hydroxy mixed ethers"), based on the tablet as a whole or on the phase which has the cavity.

The nonionic surfactant(s) may be introduced into the detergents according to the invention in various ways. For example, the surfactants may be sprayed in molten form onto the otherwise complete premix to be tabletted or may be added to the premix in the form of compounds or surfactant preparations. In a particularly preferred embodiment, high-surfactant particles, so-called rinse agent particles, are added to particulate premixes.

These rinse agent particles may be added as a particulate component to the premix to be tabletted. The quantity of surfactants in the end product (or in the particular phase of the end product) can be influenced both through the quantity of rinse agent particles and through their nonionic surfactant content. Premixes for tabletting to laundry or dishwasher detergent tablets according to the invention or phases thereof preferably contain a particulate rinse agent which, based on its weight, contains a) 20 to 90% by weight of one or more carrier materials from the group of builders, b) 10 to 40% by weight of one or more nonionic surfactants and c) 0 to 70% by weight of other active ingredients and auxiliaries.

Particularly preferred rinse agent particles contain one or more substances from the groups of phosphates, carbonates, hydrogen carbonates and/or silicates in quantities of 25 to 85% by weight, preferably 35 to 82.5% by weight and more particularly 45 to 80% by weight, based on the weight of the particulate rinse agent, as carriers a). These substances are described in the following:

Among the phosphates, alkali metal phosphates are particularly preferred carrier materials for the rinse agent particles. "Alkali metal phosphates" is the collective term for the alkali metal (more particularly sodium and potassium) salts of the various phosphoric acids, including metaphosphoric acids $(HPO_3)_n$ and orthophosphoric acid ($H_3PO_4$) and representatives of higher molecular weight. The phosphates combine several advantages: they act as alkalinity sources, prevent lime deposits on machine parts and lime incrustations in fabrics and, in addition, contribute towards the cleaning effect.

Sodium dihydrogen phosphate ($NaH_2PO_4$) exists as the dihydrate (density 1.91 $gcm^{-3}$, melting point 60°) and as the monohydrate (density 2.04 $gcm^{-3}$). Both salts are white readily water-soluble powders which, on heating, lose the water of crystallization and, at 200° C., are converted into the weakly acidic diphosphate (disodium hydrogen diphosphate, $Na_2H_2P_2O_7$) and, at higher temperatures, into sodium trimetaphosphate ($Na_3P_3O_9$) and Maddrell's salt (see below). $NaH_2PO_4$ shows an acidic reaction. It is formed by adjusting phosphoric acid with sodium hydroxide to a pH value of 4.5 and spraying the resulting "mash". Potassium dihydrogen phosphate (primary or monobasic potassium phosphate, potassium biphosphate, KDP), $KH_2PO_4$, is a white salt with a density of 2.33 $gcm^{-3}$, has a melting point of 253° [decomposition with formation of potassium polyphosphate $(KPO_3)_x$] and is readily soluble in water.

Disodium hydrogen phosphate (secondary sodium phosphate), $Na_2HPO_4$, is a colorless, readily water-soluble crystalline salt. It exists in water-free form and with 2 mol (density 2.066 $gcm^{-3}$, water loss at 95°), 7 mol (density 1.68 $gcm^{-3}$, melting point 48° with loss of 5 $H_2O$) and 12 mol of water (density 1.52 $gcm^{-3}$, melting point 35° with loss of 5 $H_2O$), becomes water-free at 100° and, on fairly intensive heating, is converted into the diphosphate $Na_4P_2O_7$. Disodium hydrogen phosphate is prepared by neutralization of phosphoric acid with soda solution using phenolphthalein as indicator. Dipotassium hydrogen phosphate (secondary or dibasic potassium phosphate), $K_2HPO_4$, is an amorphous white salt which is readily soluble in water.

Trisodium phosphate, tertiary sodium phosphate, $Na_3PO_4$, consists of colorless crystals which have a density of 1.62 $gcm^{-3}$ and a melting point of 73–76° C. (decomposition) as the dodecahydrate, a melting point of 100° C. as the decahydrate (corresponding to 19–20% $P_2O_5$) and a density of 2.536 $gcm^{-3}$ in water-free form (corresponding to 39–40% $P_2O_5$). Trisodium phosphate is readily soluble in water through an alkaline reaction and is prepared by concentrating a solution of exactly 1 mole of disodium phosphate and 1 mole of NaOH by evaporation. Tripotassium phosphate (tertiary or tribasic potassium phosphate), $K_3PO_4$, is a white deliquescent granular powder with a density of 2.56 $gcm^{-3}$, has a melting point of 1340° and is readily soluble in water through an alkaline reaction. It is formed, for example, when Thomas slag is heated with coal and potassium sulfate. Despite their higher price, the more readily soluble and therefore highly effective potassium phosphates are often preferred to corresponding sodium compounds in the detergent industry.

Tetrasodium diphosphate (sodium pyrophosphate), $Na_4P_2O_7$, exists in water-free form (density 2.534 $gcm^{-3}$, melting point 988°, a figure of 880° has also been mentioned) and as the decahydrate (density 1.815–1.836 $gcm^{-3}$, melting point 94° with loss of water). Both substances are colorless crystals which dissolve in water through an alkaline reaction. $Na_4P_2O_7$ is formed when disodium phosphate is heated to >200° or by reacting phosphoric acid with soda in a stoichiometric ratio and spray-drying the solution. The decahydrate complexes heavy metal salts and hardness salts and, hence, reduces the hardness of water. Potassium diphosphate (potassium pyrophosphate), $K_4P_2O_7$, exists in the form of the trihydrate and is a colorless hygroscopic powder with a density of 2.33 $gcm^{-3}$ which is soluble in water, the pH value of a 1% solution at 25° being 10.4.

Relatively high molecular weight sodium and potassium phosphates are formed by condensation of $NaH_2PO_4$ or $KH_2PO_4$. They may be divided into cyclic types, namely the sodium and potassium metaphosphates, and chain types, the sodium and potassium polyphosphates. The chain types in particular are known by various different names: fused or calcined phosphates, Graham's salt, Kurrol's salt and Maddrell's salt. All higher sodium and potassium phosphates are known collectively as condensed phosphates.

The industrially important pentasodium triphosphate, $Na_5P_3O_{10}$ (sodium tripolyphosphate), is a non-hygroscopic white water-soluble salt which crystallizes without water or with 6 $H_2O$ and which has the general formula NaO—[P(O)(ONa)—O]$_n$—Na where n=3. Around 17 g of the salt free from water of crystallization dissolve in 100 g of water at room temperature, around 20 g at 60° and around 32 g at 100°. After heating of the solution for 2 hours to 100°, around 8% orthophosphate and 15% diphosphate are formed by hydrolysis. In the preparation of pentasodium triphosphate, phosphoric acid is reacted with soda solution or sodium hydroxide in a stoichiometric ratio and the solution is spray-dried. Similarly to Graham's salt and sodium diphosphate, pentasodium triphosphate dissolves many insoluble metal compounds (including lime soaps, etc.). Pentapotassium triphosphate, $K_5P_3O_{10}$ (potassium tripolyphosphate), is marketed for example in the form of a 50% by weight solution (>23% $P_2O_5$, 25% $K_2O$). The potassium polyphosphates are widely used in the detergent industry. Sodium potassium tripolyphosphates, which may also be used in accordance with the invention, also exist. They are formed for example when sodium trimetaphosphate is hydrolyzed with KOH:

$$(NaPO_3)_3+2KOH \rightarrow Na_3K_2P_3O_{10}+H_2O$$

According to the invention, these phosphates may be used in exactly the same way as sodium tripolyphosphate, potassium tripolyphosphate or mixtures thereof. Mixtures of sodium tripolyphosphate and sodium potassium tripolyphosphate or mixtures of potassium tripolyphosphate and sodium potassium tripolyphosphate or mixtures of sodium tripolyphosphate and potassium tripolyphosphate and sodium potassium tripolyphosphate may also be used in accordance with the invention.

Other ingredients which may be used as carrier materials instead of or in addition to phosphates are carbonates and/or hydrogen carbonates, alkali metal salts—especially potassium and/or sodium salts—being particularly preferred. Preferred laundry or dishwasher detergent tablets contain carbonate(s) and/or hydrogen carbonate(s), preferably alkali metal carbonates and more particularly sodium carbonate, in quantities of 25 to 75% by weight, preferably 30 to 60% by weight and more particularly 35 to 50% by weight, based on the weight of the rinse agent particles present in them.

Other ingredients which may be present in the dishwasher detergent tablets instead of or in addition to the phosphates and/or carbonates/hydrogen carbonates mentioned are silicates, preferably alkali metal silicates and more particularly amorphous and/or crystalline sodium disilicates.

Suitable crystalline layered sodium silicates correspond to the general formula $NaMSi_xO_{2x+1}.yH_2O$, where M is sodium or hydrogen, x is a number of 1.9 to 4 and y is a number of 0 to 20, preferred values for x being 2, 3 or 4. Preferred crystalline layered silicates corresponding to the above formula are those in which M is sodium and x assumes the value 2 or 3. Both β- and δ-sodium disilicates $Na_2Si_2O_5.yH_2O$ are particularly preferred.

Amorphous sodium silicates with a modulus ($Na_2O:SiO_2$ ratio) of 1:2 to 1:3.3, preferably 1:2 to 1:2.8 and more preferably 1:2 to 1:2.6, which dissolve with delay and exhibit multiple wash cycle properties, may also be used. The delay in dissolution in relation to conventional amorphous sodium silicates can have been obtained in various ways, for example by surface treatment, compounding/compacting or by overdrying. In the context of the invention, the term "amorphous" is also understood to encompass "X-ray amorphous". In other words, the silicates do not produce any of the sharp X-ray reflexes typical of crystalline substances in X-ray diffraction experiments, but at best one or more maxima of the scattered X-radiation which have a width of several degrees of the diffraction angle. However, particularly good builder properties may even be achieved where the silicate particles produce crooked or even sharp diffraction maxima in electron diffraction experiments. This may be interpreted to mean that the products have microcrystalline regions between 10 and a few hundred nm in size, values of up to at most 50 nm and, more particularly, up to at most 20 nm being preferred. Compacted amorphous silicates, compounded amorphous silicates and overdried X-ray-amorphous silicates are particularly preferred.

The laundry or dishwasher detergent tablets according to the invention may also contain zeolites as carrier materials or in the rest of the solid matrix. Preferred detergents do not contain any zeolite as carrier material in the rinse agent particles, particularly preferred dishwasher detergent tablets containing no zeolite at all. By contrast, zeolites are preferably used in laundry detergent tablets according to the invention.

Zeolites have the following general formula:

$$M_{2/n}O.Al_2O_3.xSiO_2.yH_2O,$$

where M is a cation with the valence n, x has a value of or greater than 2 and y may assume a value of 0 to 20. The zeolite structures are formed by the connection of $AlO_4$ tetrahedra to $SiO_4$ tetrahedra, this framework being occupied by cations and water molecules. The cations in these structures are relatively mobile and may be replaced to various extents by other cations. The intercrystalline "zeolitic" water can be given off continuously and reversibly, according to the type of zeolite, whereas with some zeolite types structural changes also accompany the release or uptake of water.

In the structural subunits, the "primary structural units" ($AlO_4$ tetrahedra and $SiO_4$ tetrahedra) form so-called "secondary binding units" which assume the form of single or multiple rings. For example, 4-, 6- and 8-membered rings (termed S4R, S6R and S8R) occur in various zeolites while other types are connected by 4- and 6-membered double ring prisms (most common types: D4R as a rectangular prism and D6R as a hexagonal prism). The "secondary subunits" connect various polyhedra which are denoted by Greek letters. The most common is a polyhedron which is made up of six squares and eight equal-sided hexagons and which is called "β". Various different zeolites can be produced from these building units. At the present time, 34 natural zeolite minerals and approximately 100 synthetic zeolites are known.

The most well-known zeolite, zeolite 4 A, is a cubic assemblage of β-cages connected by D4R subunits. It belongs to zeolite structure group 3 and its three-dimensional framework has pores 2.2 Å and 4.2 Å in size. The formula unit in the elementary cell may be described thus:

$$Na_{12}[(AlO_2)_{12}(SiO_2)_{12}].27H_2O.$$

Where zeolites are used, faujasite zeolites are preferred. Together with zeolites X and Y, the mineral faujasite belongs to the faujasite types within zeolite structure group 4 which is characterized by the double 6-membered ring subunit D6R (cf. Donald W. Breck: "Zeolite Molecular Sieves", John Wiley & Sons, New York, London, Sydney, Toronto, 1974, page 92). Besides the faujasite types mentioned, the minerals chabasite and gmelinite and the synthetic zeolites R (chabasite type), S (gmelinite type), L and ZK-5 belong to zeolite structure group 4. The last two of these synthetic zeolites do not have any mineral analogs.

Faujasite zeolites are made up of β-cages tetrahedrally linked by D6R subunits, the β-cages being arranged similarly to the carbon atoms in diamond. The three-dimensional framework of the faujasite zeolites used in the process according to the invention has pores 2.2 and 7.4 Å in size. In addition, the elementary cell contains eight cavities each ca. 13 Å in diameter and may be described by the formula $Na_{86}[(AlO_2)_{86}(SiO_2)_{106}].264\ H_2O$. The framework of the zeolite X contains a void volume of around 50%, based on the dehydrated crystal, which represents the largest empty space of all known zeolites (zeolite Y: ca. 48% void volume, faujasite: ca. 47% void volume). (All data from: Donald W. Breck: "Zeolite Molecular Sieves", John Wiley & Sons, New York, London, Sydney, Toronto, 1974, pages 145, 176, 177).

In the context of the present invention, the expression "faujasite zeolite" characterizes all three zeolites which form the faujasite subgroup of zeolite structure group 4. According to the invention, therefore, zeolite Y and faujasite and mixtures of these compounds may also be used in addition to zeolite X although pure zeolite X is preferred.

Mixtures or co-crystallizates of faujasite zeolites with other zeolites, which do not necessarily have to belong to zeolite structure group 4, may also be used in accordance with the invention, the advantages of the process according to the invention becoming particularly clear when at least 50% by weight of the powdering composition consists of a faujasite zeolite. It is also possible, for example, to use the minimum quantity of a faujasite zeolite (0.5% by weight, based on the weight of the tablet formed) and conventional zeolite A as the rest of the powdering composition. At all events, however, the powdering compositions preferably consists solely of one or more faujasite zeolites, zeolite X again being preferred.

The aluminium silicates used in the laundry or dishwasher detergents tablets according to the invention are commercially obtainable and the methods for their production are described in standard works.

Examples of commercially available X-type zeolites may be described by the following formulae:

$$Na_{86}[(AlO_2)_{86}(SiO_2)_{106}].xH_2O,$$

$$K_{86}[(AlO_2)_{86}(SiO_2)_{106}].xH_2O,$$

$$Ca_{40}Na_6[(AlO_2)_{86}(SiO_2)_{106}].xH_2O,$$

$$Sr_{21}Ba_{22}[(AlO_2)_{86}(SiO_2)_{106}].xH_2O,$$

in which x may assume a value of 0 to 276 and which have pore sizes of 8.0 to 8.4 Å.

For example, a co-crystallizate of zeolite X and zeolite A (ca. 80% by weight zeolite X), which is marketed by CONDEA Augusta S.p.A. under the name of VEGOBOND AX® and which may be described by the following formula:

$$nNa_2O.(1-n)K_2O.Al_2O_3.(2-2.5)SiO_2(3.5-5.5)H_2O$$

is commercially obtainable and may be used with advantage in the process according to the invention.

Zeolites of the Y type are also commercially obtainable and may be described, for example, by the following formulae:

$$Na_{56}[(AlO_2)_{56}(SiO_2)_{136}].xH_2O,$$

$$K_{56}[(AlO_2)_{56}(SiO_2)_{136}].xH_2O,$$

in which x is a number of 0 to 276 and which have pore sizes of 8.0 Å.

The builders mentioned above may be present as carrier materials in the rinse agent particles although they may also additionally or exclusively be part of the "rest of the" laundry or dishwasher detergent tablets.

The rinse agent particles which may be used in the laundry or dishwasher detergent tablets according to the invention contain the nonionic surfactant(s) described in detail in the foregoing as a second constituent. Even in cases where the laundry or dishwasher detergent tablets according to the invention contain the nonionic surfactant(s) in the form of separate rinse agent particles, preferred tablets are those in which the particulate rinse agent contains mixtures of alkoxylated alcohols and hydroxy mixed ethers in quantities of 10 to 35% by weight, preferably in quantities of 10.5 to 30% by weight and more particularly in quantities of 11 to 20% by weight, based on the weight of the particulate rinse agent, as nonionic surfactants b).

The cavity tablets according to the invention may contain other ingredients which are either present as active ingredients or auxiliaries in the rinse agent particles or are otherwise incorporated in the detergents. These substances are described in the following and may be present as further active ingredients or auxiliaries in the rinse agent particles or, alternatively, may additionally or exclusively be part of the "rest of the" cavity tablets.

Where rinse agent particles are used, preferred laundry or dishwasher detergent tablets according to the invention are those in which the particulate rinse agent contains one or more substances from the groups of dyes, perfumes, defoamers, polymers, scale inhibitors, silver protectors, enzymes and/or mixtures thereof in quantities of 5 to 60% by weight, preferably in quantities 10 to 50% by weight and more particularly in quantities 15 to 30% by weight, based on the weight of the particulate rinse agent, as further active ingredients and/or auxiliaries c).

Besides the substances mentioned above, bleaching agents, bleach activators, cobuilders, chelating and complexing agents, water-softening substances, acidifying and/or alkalizing agents and fillers, release agents and anti-lumping agents are preferred constituents of the cavity tablets according to the invention. The first three substances mentioned are advantageously not incorporated in the rinse agent particles.

To sum up, preferred cavity tablets according to the invention are characterized in that they additionally contain one or more substances from the groups of surfactants, enzymes, bleaching agents, bleach activators, corrosion inhibitors, scale inhibitors, cobuilders, dyes and/or perfumes, soil release polymers, optical brighteners, dye transfer or redeposition inhibitors in quantities of 25 to 70% by weight, preferably in quantities of 30 to 60% by weight and more particularly in quantities of 40 to 50% by weight, based on the weight of the detergent as a whole.

Among the compounds yielding $H_2O_2$ in water which serve as bleaching agents, sodium percarbonate is particularly important. "Sodium percarbonate" is a non-specific term used for sodium carbonate peroxohydrates which, strictly speaking, are not "percarbonates" (i.e. salts of percarbonic acid), but hydrogen peroxide adducts with sodium carbonate. The commercial material has the mean composition 2 $Na_2CO_3.3H_2O_2$ and, accordingly, is not a peroxycarbonate. Sodium percarbonate forms a white water-soluble powder with a density of 2.14 $gcm^{-3}$ which readily decomposes into sodium carbonate and bleaching or oxidizing oxygen.

Sodium carbonate peroxohydrate was obtained for the first time in 1899 by precipitation with ethanol from a solution of sodium carbonate in hydrogen peroxide, but was mistakenly regarded as peroxycarbonate. It was only in 1909 that the compound was recognised as a hydrogen peroxide addition compound. Nevertheless, the historical name "sodium percarbonate" has been adopted in practice. The bulk density of the end product can vary between 800 and 1200 g/l according to the production process. In general, the percarbonate is stabilized by an additional coating. Coating processes and materials are widely described in the patent literature. Basically, any commercially available percarbonate types as marketed, for example, by Solvay Interox, Degussa, Kemira and Akzo may be used in accordance with the present invention.

Other useful bleaching agents are, for example, sodium perborate tetrahydrate and sodium perborate monohydrate, peroxypyrophosphates, citrate perhydrates and $H_2O_2$-yielding peracidic salts or peracids, such as perbenzoates, peroxophthalates, diperazelaic acid, phthaloiminoperacid or diperdodecane dioic acid. Even if bleaching agents are used, surfactants and/or builders do not have to be incorporated so that pure bleaching tablets can be produced. If these bleaching tablets are to be used for washing laundry, a combination of sodium percarbonate with sodium sesquicarbonate is preferred, irrespective of what other ingredients are present in the detergents. The detergents according to the invention may also contain bleaching agents from the group of organic bleaches. Typical organic bleaching agents are diacyl peroxides, such as dibenzoyl peroxide for example. Other typical organic bleaching agents are the peroxy acids, of which alkyl peroxy acids and aryl peroxy acids are particularly mentioned as examples. Preferred representatives are (a) peroxybenzoic acid and ring-substituted derivatives thereof, such as alkyl peroxybenzoic acids, but also peroxy-α-naphthoic acid and magnesium monoperphthalate, (b) aliphatic or substituted aliphatic peroxy acids, such as peroxylauric acid, peroxystearic acid, ε-phthalimidoperoxycaproic acid [phthaloiminoperoxyhexanoic acid (PAP)], o-carboxybenzamidoperoxycaproic acid, N-nonenylamidoperadipic acid and N-nonenylamidopersuccinates and (c) aliphatic and araliphatic peroxydicarboxylic acids, such as 1,12-diperoxycarboxylic acid, 1,9-diperoxyazelaic acid, diperoxysebacic acid, diperoxybrassylic acid, diperoxyphthalic acids, 2-decyldiperoxybutane-1,4-dioic acid, N,N-terephthaloyl-di(6-aminopercaproic acid).

Other suitable bleaching agents are chlorine- or bromine-releasing substances. Suitable chlorine- or bromine-releasing materials are, for example, heterocyclic N-bromamides and N-chloramides, for example trichloroisocyanuric acid, tribromoisocyanuric acid, dibromoisocyanuric acid and/or dichloroisocyanuric acid (DICA) and/or salts thereof with cations, such as potassium and sodium. Hydantoin compounds, such as 1,3-dichloro-5,5-dimethyl hydantoin, are also suitable.

In order to obtain an improved bleaching effect where washing or cleaning is carried out or below temperatures of 60° C., bleach activators may be incorporated. Bleach activators which support the effect of the bleaching agents are, for example, compounds which contain one or more N- or O-acyl groups, such as substances from the class of anhydrides, esters, imides and acylated imidazoles or oximes. Examples are tetraacetyl ethylenediamine (TAED), tetraacetyl methylenediamine (TAMD) and tetraacetyl hexylenediamine (TAHD) and also pentaacetyl glucose (PAG), 1,5-diacetyl-2,2-dioxohexaydro-1,3,5-triazine (DADHT) and isatoic anhydride (ISA).

Suitable bleach activators are compounds which form aliphatic peroxocarboxylic acids containing preferably 1 to 10 carbon atoms and more preferably 2 to 4 carbon atoms and/or optionally substituted perbenzoic acid under perhydrolysis conditions. Substances bearing O- and/or N-acyl groups with the number of carbon atoms mentioned and/or optionally substituted benzoyl groups are suitable. Preferred bleach activators are polyacylated alkylenediamines, more particularly tetraacetyl ethylenediamine (TAED), acylated triazine derivatives, more particularly 1,5-diacetyl-2,4-dioxohexahydro-1,3,5-triazine (DADHT), acylated glycolurils, more particularly tetraacetyl glycoluril (TAGU), N-acylimides, more particularly N-nonanoyl succinimide (NOSI), acylated phenol sulfonates, more particularly n-nonanoyl- or isononanoyl-oxybenzenesulfonate (n- or iso-NOBS), carboxylic anhydrides, more particularly phthalic anhydride, acylated polyhydric alcohols, more particularly triacetin, ethylene glycol diacetate, 2,5-diacetoxy-2,5-dihydrofuran, n-methyl morpholinium acetonitrile methyl sulfate (MMA) and enol esters, acetylated sorbitol and mannitol and the mixtures thereof (SORMAN), acylated sugar derivatives, more particularly pentaacetyl glucose (PAG), pentaacetyl fructose, tetraacetyl xylose and octaacetyl lactose, and acetylated, optionally N-alkylated glucamine and gluconolactone, and/or N-acylated lactams, for example N-benzoyl caprolactam. Substituted hydrophilic acyl acetals and acyl lactams are also preferably used. Combinations of conventional bleach activators may also be used.

In addition to or instead of the conventional bleach activators mentioned above, so-called bleach catalysts may also be incorporated in the cleaning compositions. These substances are bleach-boosting transition metal salts or transition metal complexes such as, for example, manganese-, iron-, cobalt-, ruthenium- or molybdenum-salen or -carbonyl complexes. Manganese, iron, cobalt, ruthenium, molybdenum, titanium, vanadium and copper complexes with nitrogen-containing tripod ligands and cobalt-, iron-, copper- and ruthenium-ammine complexes may also be used as bleach catalysts.

Preferred bleach activators belong to the group of polyacylated alkylenediamines, more particularly tetraacetyl ethylenediamine (TAED), N-acyl imides, more particularly N-nonanoyl succinimide (NOSI), acylated phenol sulfonates, more particularly n-nonanoyl- or isononanoyloxybenzenesulfonate (n- or iso-NOBS) and n-methyl morpholinium acetonitrile methyl sulfate (MMA), and are preferably used in quantities of up to 10% by weight, more preferably in quantities of 0.1 to 8% by weight, most preferably in quantities of 2 to 8% by weight and, with particular advantage, in quantities of 2 to 6% by weight, based on the detergent as a whole.

Bleach-boosting transition metal complexes, more particularly containing the central atoms Mn, Fe, Co, Cu, Mo, V, Ti and/or Ru, preferably selected from the group of manganese and/or cobalt salts and/or complexes, more preferably the cobalt (ammine) complexes, cobalt (acetate) complexes, cobalt (carbonyl) complexes, chlorides of cobalt or manganese and manganese sulfate, are also present in typical quantities, preferably in a quantity of up to 5% by weight, more preferably in a quantity of 0.0025% by weight to 1% by weight and most preferably in a quantity of 0.01% by weight to 0.25% by weight, based on the detergent as a whole. In special cases, however, even more bleach activator may be used.

Other preferred cavity tablets are characterized in that they contain silver protectors from the group of triazoles, benzotriazoles, bisbenzotriazoles, aminotriazoles, alkyl aminotriazoles and transition metal salts or complexes, more particularly benzotriazole and/or alkyl aminotriazole, in quantities of 0.01 to 5% by weight, preferably in quantities of 0.05 to 4% by weight and more particularly in quantities of 0.5 to 3% by weight, based on the detergent as a whole.

To protect the tableware or the machine itself, the corrosion inhibitors mentioned may also be incorporated in the cavity tablets, silver protectors being particularly important for dishwashing machines. Known silver protectors may be used. Above all, silver protectors selected from the group of triazoles, benzotriazoles, bisbenzotriazoles, aminotriazoles, alkylaminotriazoles and the transition metal salts or complexes may generally be used. Benzotriazole and/or alkylaminotriazole is/are particularly preferred. In addition, dishwashing formulations often contain corrosion inhibitors containing active chlorine which are capable of distinctly reducing the corrosion of silver surfaces. Chlorine-free dishwashing detergents contain in particular oxygen- and nitrogen-containing organic redox-active compounds, such as dihydric and trihydric phenols, for example hydroquinone, pyrocatechol, hydroxyhydroquinone, gallic acid, phloroglucinol, pyrogallol and derivatives of these compounds. Salt-like and complex-like inorganic compounds, such as salts of the metals Mn, Ti, Zr, Hf, V, Co and Ce are also frequently used. Of these, the transition metal salts selected from the group of manganese and/or cobalt salts and/or complexes are preferred, cobalt(ammine) complexes, cobalt(acetate) complexes, cobalt(carbonyl) complexes, chlorides of cobalt or manganese and manganese sulfate being particularly preferred. Zinc compounds may also be used to prevent corrosion of tableware.

Suitable enzymes are, in particular, those from the classes of hydrolases, such as proteases, esterases, lipases or lipolytic enzymes, amylases, glycosyl hydrolases and mixtures thereof. All these hydrolases contribute to the removal of stains, such as protein-containing, fat-containing or starch-containing stains. Oxidoreductases may also be used for bleaching. Enzymes obtained from bacterial strains or fungi, such as *Bacillus subtilis, Bacillus licheniformis, Streptomyces griseus, Coprinus cinereus* and *Humicola insolens* and from genetically modified variants are particularly suitable. Proteases of the subtilisin type are preferably used, proteases obtained from *Bacillus lentus* being particularly preferred. Of particular interest in this regard are enzyme mixtures, for example of protease and amylase or protease and lipase or lipolytic enzymes or of protease, amylase and lipase or lipolytic enzymes or protease, lipase or lipolytic enzymes, but especially protease- and/or lipase-containing mixtures or mixtures with lipolytic enzymes. Examples of such lipolytic enzymes are the known cutinases. Peroxidases or oxidases have also been successfully used in some cases. Suitable amylases include in particular α-amylases, isoamylases, pullanases and pectinases.

The enzymes may be adsorbed to supports and/or encapsulated in membrane materials to protect them against premature decomposition. The percentage content of the enzymes, enzyme mixtures or enzyme granules may be, for example, from about 0.1 to 5% by weight and is preferably from 0.5 to about 4.5% by weight, based on the detergent as a whole.

Other ingredients which may be part of the detergents according to the invention are, for example, cobuilders, dyes, perfumes, soil release compounds, soil repellents, antioxidants, fluorescent whiteners, foam ihibitors, silicone and/or paraffin oils, etc. These substances are described in the following.

Useful organic builders are, for example, the polycarboxylic acids usable in the form of their sodium salts, polycarboxylic acids in this context being understood to be carboxylic acids which carry more than one acid function. These include, for example, citric acid, adipic acid, succinic acid, glutaric acid, malic acid, tartaric acid, maleic acid, fumaric acid, sugar acids, aminocarboxylic acids, nitrilotriacetic acid (NTA), providing its use is not ecologically unsafe, and mixtures thereof. Preferred salts are the salts of the polycarboxylic acids, such as citric acid, adipic acid, succinic acid, glutaric acid, tartaric acid, sugar acids and mixtures thereof.

The acids per se may also be used. Besides their building effect, the acids also typically have the property of an acidifying component and, hence, also serve to establish a relatively low and mild pH value in detergents or cleaners. Citric acid, succinic acid, glutaric acid, adipic acid, gluconic acid and mixtures thereof are particularly mentioned in this regard.

Other suitable builders are polymeric polycarboxylates, i.e. for example the alkali metal salts of polyacrylic or polymethacrylic acid, for example those with a relative molecular weight of 500 to 70,000 g/mol.

The molecular weights mentioned in this specification for polymeric polycarboxylates are weight-average molecular weights $M_w$ of the particular acid form which, basically, were determined by gel permeation chromatography (GPC) using a UV detector. The measurement was carried out against an external polyacrylic acid standard which provides realistic molecular weight values by virtue of its structural similarity to the polymers investigated. These values differ distinctly from the molecular weights measured against polystyrene sulfonic acids as standard. The molecular weights measured against polystyrene sulfonic acids are generally higher than the molecular weights mentioned in this specification.

Particularly suitable polymers are polyacrylates which preferably have a molecular weight of 2,000 to 20,000 g/mol. By virtue of their superior solubility, preferred representatives of this group are the short-chain polyacrylates which have molecular weights of 2,000 to 10,000 g/mol and, more particularly, 3,000 to 5,000 g/mol.

Also suitable are copolymeric polycarboxylates, particularly those of acrylic acid with methacrylic acid and those of acrylic acid or methacrylic acid with maleic acid. Acrylic acid/maleic acid copolymers containing 50 to 90% by weight of acrylic acid and 50 to 10% by weight of maleic acid have proved to be particularly suitable. Their relative molecular weights, based on the free acids, are generally in the range from 2,000 to 70,000 g/mol, preferably in the range from 20,000 to 50,000 g/mol and more preferably in the range from 30,000 to 40,000 g/mol.

The (co)polymeric polycarboxylates may be used either in powder form or in the form of an aqueous solution. The content of (co)polymeric polycarboxylates in the detergents is preferably from 0.5 to 20% by weight and more particularly from 3 to 10% by weight.

In order to improve solubility in water, the polymers may also contain allyl sulfonic acids such as, for example, allyloxybenzene sulfonic acid and methallyl sulfonic acid as monomer.

Other particularly preferred polymers are biodegradable polymers of more than two different monomer units, for example those which contain salts of acrylic acid and maleic acid and vinyl alcohol or vinyl alcohol derivatives as monomers or those which contain salts of acrylic acid and 2-alkylallyl sulfonic acid and sugar derivatives as monomers.

Other preferred copolymers are those which preferably contain acrolein and acrylic acid/acrylic acid salts or acrolein and vinyl acetate as monomers.

Other preferred builders are polymeric aminodicarboxylic acids, salts or precursors thereof. Polyaspartic acids or salts and derivatives thereof which have a bleach-stabilizing effect besides cobuilder properties are particularly preferred.

Other suitable builders are polyacetals which may be obtained by reaction of dialdehydes with polyol carboxylic acids containing 5 to 7 carbon atoms and at least three hydroxyl groups. Preferred polyacetals are obtained from dialdehydes, such as glyoxal, glutaraldehyde, terephthalaldehyde and mixtures thereof and from polyol carboxylic acids, such as gluconic acid and/or glucoheptonic acid.

Other suitable organic builders are dextrins, for example oligomers or polymers of carbohydrates which may be obtained by partial hydrolysis of starches. The hydrolysis may be carried out by standard methods, for example acid- or enzyme-catalyzed methods. The end products are preferably hydrolysis products with average molecular weights of 400 to 500,000 g/mol. A polysaccharide with a dextrose equivalent (DE) of 0.5 to 40 and, more particularly, 2 to 30 is preferred, the DE being an accepted measure of the reducing effect of a polysaccharide by comparison with dextrose which has a DE of 100. Both maltodextrins with a DE of 3 to 20 and dry glucose sirups with a DE of 20 to 37 and also so-called yellow dextrins and white dextrins with relatively high molecular weights of 2,000 to 30,000 g/mol may be used.

The oxidized derivatives of such dextrins are their reaction products with oxidizing agents which are capable of oxidizing at least one alcohol function of the saccharide ring to the carboxylic acid function. A product oxidized at $C_6$ of the saccharide ring can be particularly advantageous.

Other suitable cobuilders are oxydisuccinates and other derivatives of disuccinates, preferably ethylenediamine disuccinate. Ethylenediamine-N,N'-disuccinate (EDDS) is preferably used in the form of its sodium or magnesium salts. Glycerol disuccinates and glycerol trisuccinates are also preferred in this connection. The quantities used in zeolite-containing and/or silicate-containing formulations are from 3 to 15% by weight.

Other useful organic cobuilders are, for example, acetylated hydroxycarboxylic acids and salts thereof which may optionally be present in lactone form and which contain at least 4 carbon atoms, at least one hydroxy group and at most two acid groups.

Another class of substances with co-builder properties are the phosphonates, more particularly hydroxyalkane and aminoalkane phosphonates. Among the hydroxyalkane phosphonates, 1-hydroxyethane-1,1-diphosphonate (HEDP) is particularly important as a cobuilder. It is preferably used in the form of the sodium salt, the disodium salt showing a neutral reaction and the tetrasodium salt an alkaline reaction (pH 9). Preferred aminoalkane phosphonates are ethylenediamine tetramethylene phosphonate (EDTMP), diethylenetriamine pentamethylenephosphonate (DTPMP) and higher homologs thereof. They are preferably used in the form of the neutrally reacting sodium salts, for example as the hexasodium salt of EDTMP or as the hepta- and octasodium salts of DTPMP. Of the phosphonates, HEDP is preferably used as a builder. In addition, the aminoalkane phosphonates have a pronounced heavy metal binding capacity. Accordingly, it can be of advantage, particularly where the detergents also contain bleach, to use aminoalkane phosphonates, more particularly DTPMP, or mixtures of the phosphonates mentioned.

In addition, any compounds capable of forming complexes with alkaline earth metal ions may be used as cobuilders.

In order to improve their aesthetic impression, the detergents according to the invention may be completely or partly colored (for example only individual layers or the cavity filling) with suitable dyes. Preferred dyes, which are not difficult for the expert to choose, have high stability in storage, are not affected by the other ingredients of the compositions or by light and do not have any pronounced substantivity for the treated substrates, for example tableware, so as not to color them.

Any dyes which can be destroyed by oxidation in the washing process and mixtures thereof with suitable blue dyes, so-called blueing agents, are preferably used in detergent tablets according to the invention. It has proved to be of advantage to use dyes which are soluble in water or—at room temperature—in liquid organic substances. Suitable dyes are, for example, anionic dyes, for example anionic nitroso dyes. One possible dye is, for example, naphthol green (Color Index (CI) Part 1: Acid Green 1; Part 2: 10020), which is commercially available for example as Basacid® Grün 970 from BASF, Ludwigshafen, and mixtures thereof with suitable blue dyes. Other suitable dyes are Pigmosol® Blau 6900 (CI 74160), Pigmosol® Grün 8730 (CI 74260), Basonyl® Rot 545 FL (CI 45170), Sandolan® Rhodamin EB 400 (CI 45100), Basacid® Gelb 094 (CI 47005), Sicovit® Patentblau 85 E 131 (CI 42051), Acid Blue 183 (CAS 12217-22-0, CI Acid Blue 183), Pigment Blue 15 (CI 74160), Supranol® Blau GLW (CAS 12219-32-8, CI Acid Blue 221)), Nylosan® Gelb N-7GL SGR (CAS 61814-57-1, CI Acid Yellow 218) and/or Sandolan® Blau (CI Acid Blue 182, CAS 12219-26-0).

In selecting the dye, it is important to ensure that the dye does not have an excessive affinity for the textile surfaces and, in particular, for synthetic fibers. Another factor to be taken into account in the selection of suitable dyes is that dyes differ in their stability to oxidation. Generally speaking, water-insoluble dyes are more stable to oxidation than water-soluble dyes. The concentration of the dye in the detergents varies according to its solubility and hence its sensitivity to oxidation. In the case of readily water-soluble dyes, for example the above-mentioned Basacid® Grün and Sandolan® Blau, dye concentrations in the range from a few $10^{-2}$ to $10^{-3}$% by weight are typically selected. By contrast, in the case of the pigment dyes which are particularly preferred for their brilliance, but which are less readily soluble in water, for example the above-mentioned Pigmosol® dyes, suitable concentrations of the dye in detergents and cleaning compositions are typically of the order of a few $10^{-3}$ to $10^{-4}$% by weight.

Perfumes are added to the detergents according to the invention in order to improve the aesthetic impression created by the products and to provide the consumer not only with the required performance but also with a visually and sensorially "typical and unmistakable" product. Suitable perfume oils or perfumes include individual perfume compounds, for example synthetic products of the ester, ether, aldehyde, ketone, alcohol and hydrocarbon type. Perfume compounds of the ester type are, for example, benzyl acetate, phenoxyethyl isobutyrate, p-tert.butyl cyclohexyl acetate, linalyl acetate, dimethyl benzyl carbinyl acetate, phenyl ethyl acetate, linalyl benzoate, benzyl formate, ethyl methyl phenyl glycinate, allyl cyclohexyl propionate, styrallyl propionate and benzyl salicylate. The ethers include, for example, benzyl ethyl ether; the aldehydes include, for example, the linear alkanals containing 8 to 18 carbon atoms, citral, citronellal, citronellyloxyacetaldehyde, cyclamen aldehyde, hydroxycitronellal, lilial and bourgeonal; the ketones include, for example, the ionones, α-isomethyl ionone and methyl cedryl ketone; the alcohols include anethol, citronellol, eugenol, geraniol, linalool, phenyl ethyl alcohol and terpineol and the hydrocarbons include, above all, the terpenes, such as limonene and pinene. However, mixtures of various perfumes which together produce an attractive perfume note are preferably used. Perfume oils such as these may also contain natural perfume mixtures obtainable from vegetable sources, for example pine, citrus, jasmine, patchouli, rose or ylang-ylang oil. Also suitable are clary oil, camomile oil, clove oil, melissa oil, mint oil, cinnamon leaf oil, lime blossom oil, juniper berry oil, vetiver oil, olibanum oil, galbanum oil and ladanum oil and orange blossom oil, neroli oil, orange peel oil and sandalwood oil.

The perfume content of the detergents according to the invention is normally up to 2% by weight, based on the formulation as a whole. The perfumes may be directly incorporated in the detergents according to the invention, although it can also be of advantage to apply the perfumes to supports which strengthen the adherence of the perfume to the washing and which provide the textiles with a long-lasting fragrance through a slower release of the perfume. Suitable support materials are, for example, cyclodextrins, the cyclodextrin/perfume complexes optionally being coated with other auxiliaries.

Foam inhibitors which may be used in the detergents according to the invention include, for example, soaps, paraffins or silicone oils which may optionally be applied to carrier materials.

The laundry or dishwasher detergent tablets according to the invention may contain one or more optical brightener(s). These substances, which are also known as "whiteners", are used in modern detergents because even freshly washed and bleached white laundry has a slight yellowish tinge. Optical brighteners are organic dyes which convert part of the invisible UV radiation in sunlight into longer wave blue light. The emission of this blue light fills the "gap" in the light reflected by the fabric, so that a fabric treated with optical brightener appears whiter and brighter to the eye. Since the action mechanism of brighteners presupposes their absorption onto the fibers, brighteners are differentiated according to the fibers "to be colored", for example as brighteners for cotton, polyamide or polyester fibers. The commercially available brighteners suitable for incorporation in detergents largely belong to five structural groups, namely: the stilbene, the diphenyl stilbene, the coumarin/quinoline and the diphenyl pyrazoline group and the group where benzoxazole or benzimidazole is combined with conjugated systems. Suitable brighteners are, for example, salts of 4,4'-bis-[(4-anilino-6-morpholino-s-triazin-2-yl)-amino]-stilbene-2,2'-disulfonic acid or compounds of similar structure which, instead of the morpholino group, contain a diethanolamino group, a methylamino group, an anilino group or a 2-methoxyethylamino group. Brighteners of the substituted diphenyl styryl type, for example alkali metal salts of 4,4'-bis-(2-sulfostyryl)-diphenyl, 4,4'-bis-(4-chloro-3-sulfostyryl)-diphenyl or 4-(4-chlorostyryl)-4'-(2-sulfostyryl)-diphenyl, may also be present. Mixtures of the brighteners mentioned above may also be used.

In order to facilitate the disintegration of heavily compacted tablets, disintegration aids, so-called tablet disintegrators, may be incorporated in the tablets to shorten their disintegration times. These substanes are capable, for example, of accelerating the release of individiual regions of the tablet in relation to other regions. Tablet disintegrators or disintegration accelerators are auxiliaries which promote the rapid disintegration of tablets in water or gastric juices and the release of the pharmaceuticals in an absorbable form.

These substances, which are also known as "disintegrators" by virtue of their effect, are capable of undergoing an increase in volume on contact with water so that, on the one hand, their own volume is increased (swelling) and, on the other hand, a pressure can be generated through the release of gases which causes the tablet to disintegrate into relatively small particles. Well-known disintegrators are, for example, carbonate/citric acid systems, although other organic acids may also be used. Swelling disintegration aids are, for example, synthetic polymers, such as polyvinyl pyrrolidone (PVP), or natural polymers and modified natural substances, such as cellulose and starch and derivatives thereof, alginates or casein derivatives.

Preferred detergent tablets contain 0.5 to 10% by weight, preferably 3 to 7% by weight and more preferably 4 to 6% by weight of one or more disintegration aids, based on the weight of the tablet.

According to the invention, preferred disintegrators are cellulose-based disintegrators, so that preferred laundry or dishwasher detergent tablets contain a cellulose-based disintegrator in quantities of 0.5 to 10% by weight, preferably 3 to 7% by weight and more preferably 4 to 6% by weight. Pure cellulose has the formal empirical composition $(C_6H_{10}O_5)_n$ and, formally, is a β-1,4-polyacetal of cellobiose which, in turn, is made up of two molecules of glucose. Suitable celluloses consist of ca. 500 to 5000 glucose units and, accordingly, have average molecular weights of 50,000 to 500,000. According to the invention, cellulose derivatives obtainable from cellulose by polymer-analog reactions may also be used as cellulose-based disintegrators. These chemically modified celluloses include, for example, products of esterification or etherification reactions in which hydroxy hydrogen atoms have been substituted. However, celluloses in which the hydroxy groups have been replaced by functional groups that are not attached by an oxygen atom may also be used as cellulose derivatives. The group of cellulose derivatives includes, for example, alkali metal celluloses, carboxymethyl cellulose (CMC), cellulose esters and ethers and aminocelluloses. The cellulose derivatives mentioned are preferably not used on their own, but rather in the form of a mixture with cellulose as cellulose-based disintegrators. The content of cellulose derivatives in mixtures such as these is preferably below 50% by weight and more preferably below 20% by weight, based on the cellulose-based disintegrator. In one particularly preferred embodiment, pure cellulose free from cellulose derivatives is used as the cellulose-based disintegrator.

The cellulose used as disintegration aid is preferably not used in fine-particle form, but is converted into a coarser form, for example by granulation or compacting, before it is added to and mixed with the premixes to be tabletted. The particle sizes of such disintegration aids is mostly above 200 μm, preferably at least 90% by weight of the particles being between 300 and 1600 μm in size and, more particularly, between 400 and 1200 μm in size. According to the invention, the above-described relatively coarse-particle cellulose-based disintegrators described in detail in the cited documents are preferably used as disintegration aids and are commercially obtainable, for example under the name of Arbocel® TF-30-HG from Rettenmaier.

Microcrystalline cellulose may be used as another cellulose-based disintegration aid or as part of such a component. This microcrystalline cellulose is obtained by partial hydrolysis of the celluloses under conditions which only attack and completely dissolve the amorphous regions (ca. 30% of the total cellulose mass) of the celluloses, but leave the crystalline regions (ca. 70%) undamaged. Subsequent de-aggregation of the microfine celluloses formed by hydrolysis provides the microcrystalline celluloses which have primary particle sizes of ca. 5 μm and which can be compacted, for example, to granules with a mean particle size of 200 μm.

According to the invention, preferred laundry or dishwasher detergent tablets additionally contain a disintegration aid, preferably a cellulose-based disintegration aid, preferably in granular, co-granulated or compacted form, in quantities of 0.5 to 10% by weight, preferably in quantities of 3 to 7% by weight and more preferably in quantities of 4 to 6% by weight, based on tablet weight.

The laundry or dishwasher detergent tablets according to the invention may additionally contain a gas-evolving effervescent system which is incorporated in one or more of the premixes to be processed. The gas-evolving effervescent system may consist of a single substance which releases a gas on contact with water. Among these compounds, particular mention is made of magnesium peroxide which releases oxygen on contact with water. However, the gas-releasing effervescent system normally consists of at least two constituents which react with one another to form a gas. Although various possible systems could be used, for example systems releasing nitrogen, oxygen or hydrogen, the effervescent system used in the laundry or dishwasher detergent tablets according to the invention should be selected with both economic and ecological considerations in mind. Preferred effervescent systems consist of alkali metal carbonate and/or hydrogen carbonate and an acidifying agent which is capable of releasing carbon dioxide from the alkali metal salts in aqueous solution.

Among the alkali metal carbonates and hydrogen carbonates, the sodium and potassium salts are preferred to the other salts for reasons of cost. The pure alkali metal carbonates and hydrogen carbonates do not of course have to be used, instead mixtures of different carbonates and hydrogen carbonates may be preferred from the washing performance perspective.

In preferred detergent tablets, 2 to 20% by weight, preferably 3 to 15% by weight and more preferably 5 to 10% by weight of an alkali metal carbonate or hydrogen carbonate and 1 to 15% by weight, preferably 2 to 12% by weight and more preferably 3 to 10% by weight of an acidifying agent, based on the tablet as a whole, are used as the effervescent system. The content of the substances mentioned in individual premixes may quite easily be higher.

Suitable acidifying agents which release carbon dioxide from the alkali metal salts in aqueous solution are, for example, boric acid and alkali metal hydrogen sulfates, alkali metal dihydrogen phosphates and other inorganic salts. However, organic acidifying agents are preferably used, citric acid being a particularly preferred acidifying agent. However, other solid mono-, oligo- and polycarboxylic acids in particular may also be used. Within this group, tartaric acid, succinic acid, malonic acid, adipic acid, maleic acid, fumaric acid, oxalic acid and polyacrylic acid are preferred. Organic sulfonic acids, such as amidosulfonic acid, may also be used. Sokalan® DCS (trademark of BASF), a mixture of succinic acid (max. 31% by weight), glutaric acid (max. 50% by weight) and adipic acid (max. 33% by weight), is commercially obtainable and may also be used with advantage as an acidifying agent for the purposes of the present invention.

According to the invention, preferred laundry or dishwasher detergent tablets are those in which a substance selected from the group of organic di-, tri- and oligocarboxylic acids or mixtures thereof is present as the acidifying agent in the effervescent system.

The function of redeposition inhibitors is to keep the soil detached from the fibers suspended in the wash liquor and thus to prevent the soil from being re-absorbed by the washing. Suitable redeposition inhibitors are water-soluble, generally organic colloids, for example the water-soluble salts of polymeric carboxylic acids, glue, gelatine, salts of ether carboxylic acids or ether sulfonic acids of starch or cellulose or salts of acidic sulfuric acid esters of cellulose or starch. Water-soluble polyamides containing acidic groups are also suitable for this purpose. Soluble starch preparations and other starch products than those mentioned above, for example degraded starch, aldehyde starches, etc., may also be used. Polyvinyl pyrrolidone is also suitable. However, cellulose ethers, such as carboxymethyl cellulose (sodium salt), methyl cellulose, hydroxyalkyl cellulose, and mixed ethers, such as methyl hydroxyethyl cellulose, methyl hydroxypropyl cellulose, methyl carboxymethyl cellulose and mixtures thereof are preferably used, for example in quantities of 0.1 to 5% by weight, based on the detergent.

Since sheet-form textiles, more particularly of rayon, rayon staple, cotton and blends thereof, can tend to crease because the individual fibers are sensitive to sagging, kinking, pressing and crushing transversely of the fiber direction, the cavity tablets may contain synthetic anticrease agents, including for example synthetic products based on fatty acids, fatty acid esters, fatty acid amides, alkylol esters, alkylol amides or fatty alcohols, which are generally reacted with ethylene oxide, or products based on lecithin or modified phosphoric acid esters.

To control microorganisms, the cavity tablets may contain antimicrobial agents. According to the antimicrobial spectrum and the action mechanism, antimicrobial agents may be divided into bacteriostatic agents and bactericides, fungistatic agents and fungicides, etc. Important representatives of these groups are, for example, benzalkonium chlorides, alkylaryl sulfates, halophenols and phenol mercury acetate, although these compounds may also be absent altogether.

In order to prevent unwanted changes in the detergents and/or the fabrics treated with them attributable to the effects of oxygen and other oxidative processes, the detergents may contain antioxidants. This class of compounds includes, for example, substituted phenols, hydroquinones, pyrocatechols and aromatic amines and also organic sulfides, polysulfides, dithiocarbamates, phosphites and phosphonates.

Wearing comfort can be increased by the additional use of antistatic agents which are additionally incorporated in the detergents according to the invention. Antistatic agents increase surface conductivity and thus provide for the improved dissipation of any charges which have built up. External antistatic agents are generally substances containing at least one hydrophilic molecule ligand and form a more or less hygroscopic film on the surfaces. These generally interfacially active antistatic agents may be divided into nitrogen-containing antistatics (amines, amides, quaternary ammonium compounds), phosphorus-containing antistatics (phosphoric acid esters) and sulfur-containing antistatics (alkyl sulfonates, alkyl sulfates). The lauryl (or stearyl) dimethyl benzyl ammonium chlorides disclosed therein are suitable as antistatic agents for textiles and as detergent additives and additionally develop a conditioning effect.

In order to improve the water absorption capacity and rewettability of the treated textiles and to make them easier to iron, silicone derivatives may be used in the cavity tablets. Silicone derivatives additionally improve the rinsing out behavior of the detergents through their foam-inhibiting properties. Preferred silicone derivatives are, for example, polydialkyl and alkylaryl siloxanes where the alkyl groups contain 1 to 5 carbon atoms and are completely or partly fluorinated. Preferred silicones are polydimethyl siloxanes which may optionally be derivatized and, in that case, are aminofunctional or quaternized or contain Si—OH—, Si—H— and/or Si—Cl bonds. The preferred silicones have viscosities at 25° C. of 100 to 100,000 centistokes and may be used in quantities of 0.2 to 5% by weight, based on the detergent as a whole.

Finally, the cavity tablets according to the invention may also contain UV filters which are absorbed onto the treated textiles and which improve the light stability of the fibers. Compounds which have these desirable properties are, for example, the compounds acting by "radiationless" deactivation and derivatives of benzophenone with substituents in the 2 position and/or 4 position. Substituted benzotriazoles, 3-phenyl-substituted acrylates (cinnamic acid derivatives), optionally with cyano groups in the 2-position, salicylates, organic Ni complexes and natural substances, such as umbelliferone and the body's own urocanic acid, are also suitable.

The cavity tablets according to the invention are particularly suitable for incorporating other ingredients in the cavity. For example, a liquid can be poured into the cavity, solidifying by cooling, setting, chemical reaction, delayed binding of water, changes in rheological properties, etc. However, particulate fillings can also be provided for the cavity which are fixed therein by adhesion promoters. A special instance of this is the insertion of a single particle (also referred to hereinafter as "core") which adheres to the cavity either through the use of adhesion promoters or by physical forces. Last but not least, a particulate premix may be pressed into the cavity where it also forms a phase. Where adhesion promoters are used, they may either be introduced into the cavity before introduction of the cavity filling or thereafter ("spray adhesive effect"). The application of adhesion promoters is necessary in particular when the active ingredients to be subsequently introduced are not sufficiently adhesive on their own to remain at least partly in the cavity and to withstand the mechanical stresses involved in packaging, transportation and handling without any erosion. Accordingly, the adhesion promoter is intended to "stick" cores or compounds in the cavity where they are not sufficiently adhesive on their own.

Suitable adhesion promoters are substances which provide the surfaces of the tablet to which they are applied with sufficient adhesiveness ("tackiness") for the substances applied in the following step of the process to adhere permanently to those surfaces. In principle, the substances mentioned in the relevant literature on adhesives and, in particular, in the textbooks on this subject are suitable as adhesion promoters. According to the present invention, particular significance attaches to the application of melts which have an adhesion-promoting effect at elevated temperature, but are solid, i.e. no longer tacky, after cooling.

Melts of one or more substances with a melting range of 40° C. to 75° C. are preferred adhesion promoters.

The adhesion promoters are expected to satisfy various requirements on the one hand in relation to their melting or solidification behavior and, on the other hand, in regard to their material properties in the solidified state at ambient temperature. Since the layer of adhesion promoter applied to the tablet is intended permanently to hold the active substances "stuck on" during transportation or storage, it must be highly resistant to the impacts encountered, for example, during packaging or transportation. Accordingly, the adhesion promoters should either have at least partly elastic or at least plastic properties in order to be able to react to impact through elastic or plastic deformation without breaking up. The adhesion promoters should have a melting range (solidification range) in a temperature range in which the active substances to be applied are not exposed to excessive heat. On the other hand, however, the melting range must be high enough to afford the active substances applied effective adhesion at at least slightly elevated temperature. According to the invention, the adhesion promoters preferably have a melting point above 30° C. The width of the melting range of the adhesion promoters also impacts directly on the operation of the process. The tablet coated with adhesion promoter has to be brought into contact with the active substances to be applied in the following process step without any loss of adhesiveness in the meantime. After the active substances have been applied, adhesiveness should be reduced as quickly as possible in order to avoid unnecessary losses of time and caking or blockages in following process steps or during handling and packaging. In cases where melts are used, the reduction in adhesiveness can be supported by cooling (for example by blowing on cold air).

It has been found to be of advantage if the adhesion promoters do not have a sharply defined melting point, as would normally be the case with pure crystalline substances, but rather a melting range possibly covering several degrees Celsius.

The adhesion promoters preferably have a melting range of about 45° C. to about 75° C. This means in the present case that the melting range lies within the temperature range mentioned and does not denote the width of the melting range. The width of the melting range is preferably at least 1° C. and more preferably about 2 to about 3° C.

The properties mentioned above are generally exhibited by so-called waxes. "Waxes" in the context of the present invention are understood to be any of a number of natural or synthetic substances which generally melt above 40° C. without decomposing and, even just above their melting point, are of relatively low viscosity and non-stringing. Their consistency and solubility are dependent to a large extent on temperature.

Waxes are divided into three groups according to their origin, namely: natural waxes, chemically modified waxes and synthetic waxes.

The natural waxes include, for example, vegetable waxes, such as candelilla wax, carnauba wax, Japan wax, esparto grass wax, cork wax, guaruma wax, rice oil wax, sugar cane wax, ouricury wax or montan wax, animal waxes, such as bees wax, shellac wax, spermaceti, lanolin (wool wax) or uropygial fat, mineral waxes, such as ceresine or ozocerite (earth wax), or petrochemical waxes, such as petrolatum, paraffin waxes or microwaxes.

The chemically modified waxes include, for example, hard waxes, such as montan ester waxes, sassol waxes or hydrogenated jojoba waxes.

Synthetic waxes are generally understood to be polyalkylene waxes or polyalkylene glycol waxes. Compounds from other classes which satisfy the above-mentioned softening point requirements may also be used as adhesion promoters. For example, higher esters of phthalic acid, more particularly the dicyclohexyl phthalate commercially available under the name of Unimoll® 66 (Bayer AG), have proved to be suitable synthetic compounds. Synthetic waxes of lower carboxylic acids and fatty alcohols, for example the dimyristyl tartrate commercially available under the name of Cosmacol® ETLP (Condea), are also suitable. Conversely, synthetic or partly synthetic esters of lower alcohols with fatty acids from native sources may also be used. This class of substances includes, for example, Tegin® 90 (Goldschmidt), a glycerol monostearate palmitate. Shellac, for example Schellack-KPS-Dreiring-SP (Kalkhoff GmbH), may also be used as an adhesion promoter in accordance with the invention.

In the context of the invention, the waxes also include, for example, the so-called wax alcohols. Wax alcohols are relatively high molecular weight water-insoluble fatty alcohols generally containing about 22 to 40 carbon atoms. The wax alcohols are used as a principal constituent of many natural waxes, for example in the form of wax esters of relatively high molecular weight fatty acids (wax acids). Examples of wax alcohols are lignoceryl alcohol (1-tetracosanol), cetyl alcohol, myristyl alcohol or melissyl alcohol. The adhesion promoters optionally applied in step b) may also contain wool wax alcohols which are understood to be triterpenoid and steroid alcohols, for example the lanolin obtainable, for example, under the name of Argowax® (Pamentier & Co.). According to the invention, fatty acid glycerol esters or fatty acid alkanolamides and also water-insoluble or substantially water-insoluble polyalkylene glycol compounds may also be used at least partly as a constituent of the adhesion promoters.

In another preferred embodiment, the adhesion promoters predominantly contain paraffin wax. In other words, at least 50% by weight—and preferably more—of the adhesion promoters consists of paraffin wax. Paraffin wax contents in the adhesion promoter of about 60% by weight, about 70% by weight or about 80% by weight are particularly suitable, even higher contents of, for example, more than 90% by weight being particularly preferred.

So far as the present invention is concerned, paraffin waxes have the advantage over the other natural waxes mentioned that the waxes do not undergo hydrolysis in an alkaline detergent environment (as might be expected, for example, in the case of the wax esters), because paraffin wax does not contain any hydrolyzable groups.

Paraffin waxes consist principally of alkanes and small amounts of iso- and cycloalkanes. The paraffin to be used in accordance with the invention preferably contains virtually no constituents with a melting point above 70° C. and, more preferably, above 60° C. If the temperature in the cleaning solution falls below this melting temperature, high-melting alkanes in the paraffin can leave unwanted wax residues behind on the surfaces to be cleaned or the ware to be cleaned. Wax residues such as these generally leave the cleaned surface with an unattractive appearance and should therefore be avoided.

The paraffin wax used preferably has a high content of alkanes, isoalkanes and cycloalkanes solid at ambient temperature (generally about 10 to about 30° C.). The higher the percentage of solid wax constituents present in a wax at room temperature, the more useful that wax is for the purposes of the present invention as an adhesion promoter. The higher the percentage of solid wax constituents, the greater the resistance of the adhesion promoter layer to impact or friction with other surfaces, which leads to longer lasting protection of the coated active ingredients. Large percentages of oils or liquid wax constituents can weaken particle adhesion so that the active ingredients stuck on separate from the shaped body.

Besides paraffin as principal constituent, the adhesion promoters may also contain one or more of the waxes or wax-like substances mentioned above. Basically, the composition of the adhesion promoters should be such that the "adhesive layer" is at least substantially insoluble in water. Its solubility in water should not exceed about 10 mg/l at a temperature of about 30° C. and should preferably be below 5 mg/l.

If temperature-controlled release of the active ingredients stuck on is required, the adhesion promoters should have minimal solubility in water, even in water at elevated temperature, in order largely to prevent the coated active ingredients from being released independently of temperature.

The adhesion promoters can be pure substances or mixtures. In the latter case, the melt may contain varying quantities of adhesion promoters and auxiliaries.

The above-described principle is intended for the delayed separation of the active ingredients "stuck on" at a certain time, for example in the cleaning cycle of a dishwasher, and may be applied with particular advantage where the main wash cycle takes place at relatively low temperature (for example 55° C.), so that the active substance is only released from the adhesive layer in the final rinse cycle at relatively high temperatures (ca. 70° C.).

However, the principle mentioned may also be reversed to the extent that the active ingredients are released from the adhesive layer quickly rather than slowly. This may readily be achieved by using dissolution accelerators rather than dissolution retarders as adhesion promoters so that the active ingredients "stuck on" are separated from the shaped body more quickly rather than more slowly. In contrast to the substantially water-insoluble adhesion promoters described above, preferred adhesion promoters for rapid dissolution are readily soluble in water. The water solubility of the adhesion promoters can be distinctly increased by certain additives, for example by incorporation of readily soluble salts or effervescent systems. Dissolution-accelerated adhesion promoters (with or without additions of other solubility improvers) lead to the rapid dissolution and release of the active ingredients at the beginning of the cleaning cycle.

The acceleration of dissolution can also be achieved or supported by certain geometric factors. Detailed observations in this regard can be found in the following.

Synthetic waxes from the group of polyethylene glycols and polypropylene glycols are particularly suitable as adhesion promoters for the accelerated release of the active ingredients from the laundry or dishwasher detergent tablets.

Polyethylene glycols (PEGs for short) suitable for use in accordance with the invention are polymers of ethylene glycol which correspond to general formula (III):

$$H—(O—CH_2—CH_2)_n—OH \quad (III)$$

where n may assume values of 1 (ethylene glycol) to >100,000. A critical factor in evaluating whether a polyethylene glycol is suitable for use in accordance with the invention is the aggregate state of the PEG, i.e. the melting point of the PEG must be above 30° C., so that the monomer (ethylene glycol) and the lower oligomers with n=2 to ca. 16 cannot be used because they have a melting point below 30°. The polyethylene glycols with relatively high molecular weights are polymolecular, i.e. they consist of groups of macromolecules with different molecular weights. Various nomenclatures are used for polyethylene glycols which can lead to confusion. It is common practice to indicate the mean relative molecular weight after the initials "PEG", so that "PEG 200" characterizes a polyethylene glycol having a relative molecular weight of about 190 to about 210. Under this nomenclature, the standard polyethylene glycols PEG 1550, PEG 3000, PEG 4000 and PEG 6000 may be used for the purposes of the present invention.

Cosmetic ingredients are covered by another nomenclature in which the initials PEG are followed by a hyphen and the hyphen is in turn directly followed by a number which corresponds to the index n in general formula III above. Under this nomenclature (so-called INCI nomenclature, CTFA International Cosmetic Ingredient Dictionary and Handbook, 5th Edition, The Cosmetic, Toiletry and Fragrance Association, Washington, 1997), PEG-32, PEG-40, PEG-55, PEG-60, PEG-75, PEG-100, PEG-150 and PEG-180, for example, may advantageously be used in accordance with the present invention.

Polyethylene glycols are commercially obtainable, for example under the trade names of Carbowax® PEG 540 (Union Carbide), Emkapol® 6000 (ICI Americas), Lipoxol® 3000 MED (HÜLS America), Polyglycol® E-3350 (Dow Chemical), Lutrol® E4000 (BASF) and the corresponding trade names with higher numbers.

Polypropylene glycols (PPGs) suitable for use in accordance with the invention are polymers of propylene glycol which correspond to general formula IV:

$$H—(O—\underset{\underset{CH_3}{|}}{CH}—CH_2)_n—OH \quad (IV)$$

where n may assume values of 1 (propylene glycol) to about 1000. As with the PEGs described above, a critical factor in evaluating whether a polypropylene glycol is suitable for use in accordance with the invention is the aggregate state of the PPG, i.e. the melting point of the PPG must be above 30° C., so that the monomer (propylene glycol) and the lower oligomers where n=2 to about 15 cannot be used because they have a melting point below 30° C.

Besides the PEGs and PPGs preferably used as adhesion promoters, other substances may of course also be used providing they have a sufficiently high solubility in water and a melting point above 30° C.

Preferred adhesion promoters are one or more substances from the groups of paraffin waxes (preferably with a melting range of 50° C. to 55° C.) and/or polyethylene glycols (PEGs) and/or polypropylene glycols (PPGs) and/or natural waxes and/or fatty alcohols.

Besides melts, other substances may be applied as adhesion promoters. These other substances include, for example, concentrated salt solutions which, after application of the active ingredients, are converted by crystallization or evaporation into an adhesion-promoting salt crust. Supersaturated solutions or solutions of salts in solvent mixtures may of course also be used.

Solutions or suspensions of water-soluble or water-dispersible polymers, preferably polycarboxylates, may also be used as adhesion promoters. These substances were described earlier on for their cobuilder properties.

Other particularly suitable adhesion promoters are solutions of water-soluble substances from the group of (acetalized) polyvinyl alcohol, polyvinyl pyrrolidone, gelatin and mixtures thereof.

Polyvinyl alcohols, referred to in short as PVALs, are polymers with the following general structure:

$$[—CH_2—CH(OH)—]_n$$

which also contain small amounts of structural units of the following type:

$$[—CH_2—CH(OH)—CH(OH)—CH_2]$$

Since the corresponding monomer, vinyl alcohol, is not stable in free form, polyvinyl alcohols are produced via polymer-analog reactions by hydrolysis and—on an industrial scale—above all by alkali-catalyzed transesterification of polyvinyl acetates with alcohols (preferably methanol) in solution. PVALs containing a predetermined residual percentage of acetate groups can also be obtained by these industrial processes.

Commercially available PVALs (for example Mowiol® types, products of Hoechst) are marketed as white-yellowish powders or granules with degrees of polymerization of ca. 500 to 2,500 (corresponding to molecular weights of ca. 20,000 to 100,000 g/mole) and have different degrees of hydrolysis of 98–99 or 87–89 mol- %. Accordingly, they are partly saponified polyvinyl acetates with a residual content of acetyl groups of ca. 1–2 or 11–13 mol- %.

The solubility of PVAL in water can be reduced and thus selectively adjusted to required values by aftertreatment with aldehydes (acetalization), by complexing with Ni or Cu salts or by treatment with dichromates, boric acid, borax. The rheological properties of PVAL solutions can also be adjusted to the required values by altering the molecular weight or the concentration, depending on how the solution is to be applied as adhesion promoter.

Polyvinyl pyrrolidones, referred to in short as PVPs, correspond to the following general formula:

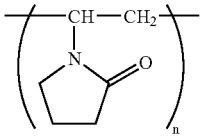

PVPs are produced by radical polymerization of 1-vinyl pyrrolidone. Commercially available PVPs have molecular weights of ca. 2,500 to 750,000 g/mol and are commercially available as white hygroscopic powders or as aqueous solutions.

Gelatin is a polypeptide (molecular weight ca. 15,000–>250,000 g/mole) which is mainly obtained by hydrolysis of the collagen present in the skin and bones of animals under acidic or alkaline conditions. The amino acid composition of gelatin largely corresponds to that of the collagen from which it was obtained and varies according to its provenance. The use of gelatin as a water-soluble capsule material is particularly widespread in pharmacy (hard or soft gelatin capsules).

Adhesion promoters from the group of starch and starch derivatives, cellulose and cellulose derivatives, more especially methyl cellulose, and mixtures thereof are also preferred for the purposes of the present invention.

Starch is a homoglycan in which the glucose units are attached by α-glycoside bonds. Starch is made up of two components of different molecular weight, namely ca. 20–30% straight-chain amylose (molecular weight ca. 50,000 to 150,000) and 70–80% of branched-chain amylopectin (molecular weight ca. 300,000 to 2,000,000). Small quantities of lipids, phosphoric acid and cations are also present. Whereas the amylose—on account of the bond in the 1,4-position—forms long, helical intertwisted chains containing about 300 to 1,200 glucose molecules, the amylopectin chain branches through a 1,6-bond after—on average—25 glucose units to form a branch-like structure containing about 1,500 to 12,000 glucose molecules. Besides pure starch, starch derivatives obtainable from starch by polymer-analog reactions may also be used in accordance with the invention for the production of water-soluble bags. Such chemically modified starches include, for example, products of esterification or etherification reactions in which hydroxy hydrogen atoms were substituted. However, starches in which the hydroxy groups have been replaced by functional groups that are not attached by an oxygen atom may also be used as starch derivatives. The group of starch derivatives includes, for example, alkali metal starches, carboxymethyl starch (CMS), starch esters and ethers and amino starches.

Pure cellulose has the formal empirical composition $(C_6H_{10}O_5)_n$ and, in formal terms, is a β-1,4-polyacetal of cellobiose which, in turn, is made up of two molecules of glucose. Suitable celluloses consist of ca. 500 to 5,000 glucose units and, accordingly, have average molecular weights of 50,000 to 500,000. Other cellulose-based disintegrating agents which may be used in accordance with the present invention are cellulose derivatives obtainable from cellulose by polymer-analog reactions. Such chemically modified celluloses include, for example, products of esterification or etherification reactions in which hydroxy hydrogen atoms were substituted. However, celluloses in which the hydroxy groups have been replaced by functional groups that are not attached by an oxygen atom may also be used as cellulose derivatives. The group of cellulose derivatives includes, for example, alkali metal celluloses, carboxymethyl cellulose (CMC), cellulose esters and ethers and also amino celluloses.

Preferred adhesion promoters, which may be used in the form of an aqueous solution, consist of a polymer with a molecular weight in the range from 5,000 to 500,000 dalton, preferably in the range from 7,500 to 250,000 dalton and more preferably in the range from 10,000 to 100,000 dalton. The layer of adhesion promoter present between the individual regions of the tablet (cavity wall and second part) after drying of the adhesion promoter preferably has a thickness of 1 to 150 μm, preferably 2 to 100 μm, more preferably 5 to 75 μm and most preferably 10 to 50 μm.

After application of the adhesion promoter, other active ingredients may be introduced into the cavity. These active ingredients may be applied in solid, highly viscous or plastic form.

The application of solid active substances to the cavity is carried out with machinery known, for example, from the confectionery industry. If a particulate solid, i.e. more than one "body", is introduced into the cavity, the active ingredients introduced into the cavity are correspondingly referred to hereinafter as "crumbs".

The precision with which a certain quantity of more active ingredient is applied varies according to the dosage and to the shape and size of the crumbs. In the application of crumbs, this dosing precision generally has a certain range of variation of about ±10%. Substances which are intended to dissolve quickly in the washing or cleaning process, for example enzymes, have proved to be particularly suitable active ingredients for the solid crumbs to be introduced into the cavity.

As already mentioned, the crumbs can be produced in different shapes and sizes. In principle, "crumb sprinkling" is also understood to be the bonding of a single dosage unit into the cavity, this single dosage unit naturally having a higher volume than the individual volume of dosage units repeatedly introduced into the cavity. According to the invention, therefore, a hemispherical crumb, for example, can be bonded into the cavity. "Crumbs" and tablets can also be made in other shapes, such as cubes, squares, semiellipsoids, cylinder segments, prisms, etc.

In preferred embodiments, however, the number of crumbs bonded into the cavity is greater than 1. Corresponding crumbs thus advantageously have the dimensions of typical laundry or dishwasherdetergents in powder, granular, extrudate, flake or platelet form and are "stuck in" in large numbers.

The introduction of additional active substance into the cavities in the form of a single dosage is also preferred. Thus, it is readily possible in accordance with the invention to bond two separately produced tablets designed to interengage or interlock with one another, one of the tablets being a cavity tablet according to the invention. Besides inserting individual dosage units which have been produced by other processes, for example casting, extrusion, molding, etc., separately produced tablets in particular may serve as a single dosage unit.

In one particularly preferred embodiment of the present invention, the cavity tablet has a cavity of which the base and/or sides are optionally provided with adhesion promoter, after which a separately produced tablet fitting into the cavity is "stuck" in place. Alternatively, the adhesion promoters may also be applied to individual surfaces of the tablet to be stuck in place.

As already mentioned, the cavity in the cavity tablet may assume any shape. It may extend throughout the tablet, i.e.

may have an opening at the top and bottom of the tablet, although it may also be a cavity which does not extend throughout the tablet, i.e. a cavity of which the opening is only visible on one side of the tablet.

The adhesion promoter may be applied either to the cavity tablet itself or to the tablet which fills the cavity. In a preferred embodiment, adhesion promoter is introduced into the cavity of the tablet.

This procedure is particularly suitable for cavity tablets because dosing can be carried out simply by introducing liquid adhesion promoters dropwise into the cavity. Suitable dosing machines for the industrial dosage of small quantities of liquids into cavities are sufficiently well known to the expert.

In many cases, it is technically simpler to apply adhesion promoter to the tablet filling the cavity. In cases such as these, adhesion promoter is applied to one or more surfaces, preferably to one surface, of the individual dosage unit.

This application of adhesion promoter to preferably one surface of the individual dosage unit may be carried out in various ways. For example, the separate dosage unit may be wetted with adhesion promoter on one side by dipping and then placed in the cavity. Although this is easy to do from the technological point of view, it does involve the danger of adhesive soiling the surface of the cavity tablet. In this variant, the quantity of adhesive can be controlled by varying the rheological properties of the adhesion promoters.

Another and—according to the invention—preferred method of applying adhesion promoter to preferably one surface of the individual dosage unit comprises moving this dosage unit past adhesive dosing systems and then placing it in the cavity. This can be done by using adhesion promoter nozzles, brushes or fleeces impregnated with adhesion promoters or by rollers. The last of these variants is particularly simple because the separate dosage unit has only a small contact surface with the roller. The adhesion promoter can be added from the interior of the roller, although it may also be applied to the roller at a point remote from the point of contact between the roller and the separate dosage units.

The filling of the cavity may completely fill the cavity or alternatively may also project from or only partly fill the cavity, no limits being imposed on the imaginativeness of the product developer. By varying the shape of the cavity tablets according to the invention, the shape of the cavity or the hole and the shape of the separate dosage unit, it is possible to produce various tablets which, visually, differ considerably from one another.

In the case of the cavity tablets, the adhesion of the separate dosage unit in the cavity decreases with decreasing contact surface. Maximum adhesion between the two tablets is obtained when the cavity tablet and the separate dosage unit interengage without any gaps.

In complete analogy to the above-described production of two-phase tablets by "sticking" two separately produced tablets onto or into one another, it is also possible to produce three-phase tablets. To this end, two separately produced tablets may be stuck into a two-cavity tablet although it is also possible and preferred to produce a two-phase tablet, for example a two-layer cavity tablet, and then to fit another tablet into the two-phase tablet.

The above-mentioned principle may be extended to other multiphase laundry and dishwasher detergent tablets. For example, four-phase tablets can be produced by joining two two-phase tablets (two-phase cavity tablet according to the invention and two-phase "core") to one another.

So far as the composition of the second part optionally introduced into the cavity is concerned, the possibilities are again limitless. For example, certain ingredients can be introduced into the second part to separate them from the ingredients in the cavity tablets according to the invention. The second part may of course also contain several ingredients or may itself be a complete laundry or dishwasher detergent composition. In a particularly preferred embodiment of the invention, the second part is formulated in such a way that it develops an additional effect in the washing or dishwashing process. For dishwasher detergents, "cores" are preferably inserted into the cavity tablets to act as a "prerinse phase", "performance booster" or "clear rinse phase", i.e. to release certain ingredients at certain times in the cleaning cycle (enzymes, for example, in the first case; bleaching agents, for example, in the second case; and surfactants or scale-inhibiting polymers or acids, for example, in the third case). In a particularly preferred embodiment, ingredients are incorporated in the "core" which make it unnecessary to add otherwise essential additional ingredients, for example rinse agent or regenerating salt. In the first case mentioned, the "core" represents a clear rinse phase; in the last case, salt substitutes are incorporated in the "core" to bind water hardness so that hard water may be used for rinsing without any danger of lime deposits remaining on the tableware or the machine.

Accordingly, particularly preferred laundry or dishwasher detergent tablets according to the invention are characterized in that they additionally comprise a second part which is in the form of a core or a body bonded onto or into the first part ("basic tablet") and which preferably contains one or more substances from the group of builders, acidifying agents, chelating agents or scale-inhibiting polymers.

Builders and acidifying agents are described in the foregoing. Another possible group of ingredients for the second part are chelating agents. Chelating agents are substances which form cyclic compounds with metal ions, an individual ligand occupying more than one co-ordination site at a central atom, i.e. is at least "bidentate", In this case, therefore, normally stretched compounds are closed to form rings by complexing via an ion. The number of bound ligands depends upon the co-ordination number of the central ion.

Typical and—according to the invention—preferred chelating agents are, for example, polyoxycarboxylic acids, polyamines, ethylenediamine tetraacetic acid (EDTA) and nitrilotriacetic acid (NTA). Complexing polymers, i.e. polymers which, either in the main chain itself or laterally thereof, carry functional groups which are capable of acting as ligands and which react with suitable metal atoms, generally to form chelate complexes, may also be used in accordance with the invention. The polymer-bound ligands of the metal complexes formed may emanate from only one macromolecule or belong to various polymer chains. The latter leads to crosslinking of the material providing the complexing polymers were not already crosslinked through covalent bonds.

Complexing groups (ligands) of typical complexing polymers are iminodiacetic acid, hydroxyquinoline, thiourea, guanidine, dithiocarbamate, hydroxamic acid, amidoxime, aminophosphonic acid, (cycl.) polyamino, mercapto, 1,3-dicarbonyl and crown ether residues with, in some cases, very specific activities towards ions of various metals. Base polymers of many—even commercially significant—complexing polymers are polystyrene, polyacrylates, polyacrylonitriles, polyvinyl alcohols, polyvinyl pyridines and polyethylene imines. Natural polymers, such as cellulose, starch or chitin, are also complexing polymers. In addition, these complexing polymers can be provided with further ligand functionalities by polymer-analog conversions.

According to the invention, particularly preferred laundry or dishwasher detergent tablets with a "second part" inserted into the cavity are characterized in that the second part contains one or more chelating agents from the groups of (i) polycarboxylic acids where the sum of carboxyl and optionally hydroxyl groups is at least 5,
(ii) nitrogen-containing mono- or polycarboxylic acids,
(iii) geminal diphosphonic acids,
(iv) aminophosphonic acids,
(v) phosphonopolycarboxylic acids,
(vi) cyclodextrins, in quantities above 0.1% by weight, preferably above 0.5% by weight, more preferably above 1% by weight and most preferably above 2.5% by weight, based on the weight of the second part.

Any known complexing agents may be used for the purposes of the present invention. They may belong to various chemical groups. The following are preferably used either individually or in the form of mixtures with one another:

a) polycarboxylic acids where the sum of carboxyl and optionally hydroxyl groups is at least 5, such as gluconic acid,
b) nitrogen-containing mono- or polycarboxylic acids, such as ethylenediamine tetraacetic acid (EDTA), N-hydroxyethyl ethylenediamine triacetic acid, diethylenetriamine pentaacetic acid, hydroxyethyl iminodiacetic acid, nitrilodiacetic acid-3-propionic acid, isoserine diacetic acid, N,N-di-(β-hydroxyethyl)-glycine, N-(1,2-dicarboxy-2-hydroxyethyl)-glycine, N-(1,2-dicarboxy-2-hydroxyethyl)-aspartic acid or nitrilotriacetic acid (NTA),
c) geminal diphosphonic acids, such as 1-hydroxyethane-1,1-diphosphonic acid (HEDP), higher homologs thereof containing up to 8 carbon atoms and hydroxyfunctional or aminofunctional derivatives thereof and 1-aminoethane-1,1-diphosphonic acid, higher homologs thereof containing up to 8 carbon atoms and hydroxyfunctional or aminofunctional derivatives thereof,
d) aminophosphonic acids, such as ethylenediamine tetra (methylene-phosphonic acid), diethylenetriamine penta (methylenephosphonic acid) or nitrilotri(methylenephosphonic acid),
e) phosphonopolycarboxylic acids, such as 2-phosphonobutane-1,2,4-tricarboxylic acid, and
f) cyclodextrins.

In the context of the present invention, polycarboxylic acids a) are also understood to encompass carboxylic acids and monocarboxylic acids where the sum of carboxyl groups and the hydroxyl groups present in the molecule is at least 5. Complexing agents from the group of nitrogen-containing polycarboxylic acids, more especially EDTA, are preferred. These complexing agents are at least partly present as anions at the alkaline pH values of the treatment solutions required in accordance with the invention. It does not matter whether they are introduced in the form of the acids or in the form of salts. Where they are used in the form of salts, alkali metal, ammonium or alkylammonium salts, especially sodium salts, are preferred.

So far as the scale-inhibiting polymers as an ingredient of the second part are concerned, particularly preferred laundry or dishwasher detergent tablets are characterized in that the second part contains one or more scale-inhibiting polymers from the group of cationic homo- or copolymers, more particularly hydroxypropyl trimethyl ammonium guar; copolymers of aminoethyl methacrylate and acrylamide, copolymers of dimethyl diallyl ammonium chloride and acrylamide, polymers containing imino groups, polymers containing quaternized ammonium alkyl methacrylate groups as monomer units, cationic polymers of such monomers as trialkylammonium alkyl(meth)acrylate or acrylamide; dialkyl diallyl ammonium salts; polymer-analog reaction products of ethers or esters of polysaccharides containing ammonium side groups, more particularly guar, cellulose and starch derivatives; polyadducts of ethylene oxide containing ammonium groups; quaternary ethyleneimine polymers and polyesters and polyamides containing quaternary side groups, in quantities above 5% by weight, preferably in quantities above 10% by weight, more preferably in quantities above 20% by weight and most preferably in quanities above 25% by weight, based on the weight of the second part.

Certain copolymers containing sulfonic acid groups represent another preferred ingredient for the second part. Thus, laundry or dishwasher detergent tablets of which the second part contains one or more copolymers of i) unsaturated carboxylic acids,
ii) monomers containing sulfonic acid groups,
iii) optionally other ionic or nonionic monomers in quantities above 5% by weight, preferably in quantities above 10% by weight, more preferably in quantities above 20% by weight and most preferably in quantities above 25% by weight, based on the weight of the second part, are also preferred embodiments of the invention.

According to the invention, preferred monomers are unsaturated carboxylic acids corresponding to formula (V):

$$R^1(R^2)C{=}C(R^3)COOH \qquad (V)$$

in which $R^1$ to $R^3$ independently of one another represent —H, —$CH_3$, a linear or branched, saturated alkyl group containing 2 to 12 carbon atoms, a linear or branched, mono- or polyunsaturated alkenyl group containing 2 to 12 carbon atoms, —$NH_2$—, —OH— or —COOH-substituted alkyl or alkenyl groups as defined above or —COOH or —$COOR^4$, where $R^4$ is a saturated or unsaturated, linear or branched hydrocarbon radical containing 1 to 12 carbon atoms.

Among the unsaturated carboxylic acids corresponding to formula (V), acrylic acid ($R^1{=}R^2{=}R^3{=}H$), methacrylic acid ($R^1{=}R^2{=}H;R^3{=}CH_3$) and/or maleic acid ($R^1{=}COOH;R^2{=}R^3{=}H$) are particularly preferred.

Preferred monomers containing sulfonic acid groups correspond to formula (VI):

$$R^5(R^6)C{=}C(R^7)—X—SO_3H \qquad (VI)$$

in which $R^5$ to $R^7$ independently of one another represent —H, —$CH_3$, a linear or branched, saturated alkyl group containing 2 to 12 carbon atoms, a linear or branched, mono- or polyunsaturated alkenyl group containing 2 to 12 carbon atoms, —$NH_2$—, —OH— or —COOH-substituted alkyl or alkenyl groups as defined above or —COOH or —$COOR^4$, where $R^4$ is a saturated or unsaturated, linear or branched hydrocarbon radical containing 1 to 12 carbon atoms, and X is an optionally present spacer group selected from —$(CH_2)_n$— with n=0 to 4, —COO—$(CH_2)_k$— with k=1 to 6, —C(O)—NH—$C(CH_3)_2$— and —C(O)—NH—CH($CH_2CH_3$)—.

Among these monomers, those corresponding to formulae (VIa), (VIb) and/or (VIc):

$$H_2C{=}CH{-}X{-}SO_3H \quad \text{(VIa)}$$

$$H_2C{=}C(CH_3){-}X{-}SO_3H \quad \text{(VIb)}$$

$$HO_3S{-}X{-}(R_6)C{=}C(R^7){-}X{-}SO_3H \quad \text{(VIc)}$$

in which $R^6$ and $R^7$ independently of one another are selected from —H, —$CH_3$, —$CH_2CH_3$, —$CH_2CH_2CH_3$, —$CH(CH_3)_2$ and X is an optionally present spacer group selected from —$(CH_2)_n$— with n=0 to 4, —COO—$(CH_2)_k$— with k=1 to 6, —C(O)—NH—$C(CH_3)_2$— and —C(O)—NH—$CH(CH_2CH_3)$—, are preferred Particularly preferred monomers containing sulfonic acid groups are 1-acrylamido-1-propanesulfonic acid (X=—C(O)NH—$CH(CH_2CH_3)$ in formula (VIa)), 2-acrylamido-2-propanesulfonic acid (X=—C(O)NH—$C(CH_3)_2$ in formula (VIa)), 2-acrylamido-2-methyl-1-propanesulfonic acid (X=—C(O)NH—$CH(CH_3)CH_2$— in formula VIa)), 2-methacrylamido-2-methyl-1-propanesulfonic acid (X=—C(O)NH—$H(CH_3)CH_2$— in formula (VIb)), 3-methacrylamido-2-hydroxypropanesulfonic acid (X=—C(O)NH—$CH_2OH(OH)CH_2$— in formula (VIb)), allyl sulfonic acid (X=$CH_2$ in formula (VIa)), methallylsulfonic acid (X=$CH_2$ in formula (VIb)), allyloxybenzenesulfonic acid (X=—$CH_2$—O—$C_6H_4$— in formula (VIa)), methallyloxybenzenesulfonic acid (X=—$CH_2$—O—$C_6H_4$— in formula (VIb)), 2-hydroxy-3-(2-propenyloxy)-propanesulfonic acid, 2-methyl-2-propene-1-sulfonic acid (X=$CH_2$ in formula (VIb)), styrenesulfonic acid (X=$C_6H_4$ in formula (VIa)), vinylsulfonic acid (X not present in formula (VIa)), 3-sulfopropylacrylate (X=—C(O)NH—$CH_2CH_2CH_2$— in formula (VIa)), 3-sulfopropylmethacyrlate (X=—C(O)NH—$CH_2CH_2CH_2$— in formula (VIb)), sulfomethacrylamide (X=—C(O)NH—in formula (VIb)), sulfomethylmethacrylamide (X=—C(O)NH—$CH_2$— in formula (VIb)) and water-soluble salts of the acids mentioned.

Suitable other ionic or nonionic monomers are, in particular, ethylenically unsaturated compounds. The polymers used in accordance with the invention preferably contain less than 20% by weight, based on polymer, of monomers belonging to group iii). Particularly preferred polymers present in the second part consist solely of monomers belonging to groups i) and ii).

Particularly preferred laundry or dishwasher detergent tablets contain one or more copolymers of i) one or more unsaturated carboxylic acids from the group consisting of acrylic acid, methacrylic acid and/or maleic acid, ii) one or more monomers containing sulfonic acid groups corresponding to formula (VIa), (VIb) and/or (VIc):

$$H_2C{=}CH{-}X{-}SO_3H \quad \text{(VIa)}$$

$$H_2C{=}C(CH_3){-}X{-}SO_3H \quad \text{(VIb)}$$

$$HO_3S{-}X{-}(R_6)C{=}C(R^7){-}X{-}SO_3H \quad \text{(VIc)}$$

in which $R^6$ and $R^7$ independently of one another are selected from —H, —$CH_3$, —$CH_2CH_3$, —$CH_2CH_2CH_3$, —$CH(CH_3)_2$ and X is an optionally present spacer group selected from —$(CH_2)_n$— with n=0 to 4, —COO—$(CH_2)_k$— with k=1 to 6, —C(O)—NH—$C(CH_3)_2$— and —C(O)—NH—$CH(CH_2CH_3)$—, iii) optionally other ionic or nonionic monomers.

in the second part.

The copolymers present in the second part may contain the monomers belonging to groups i) and ii) and optionally iii) in varying quantities, all representatives of group i) being combinable with all representatives of group ii) and all representatives of group iii). Particularly preferred polymers contain certain structural units which are described in the following.

For example, preferred laundry or dishwasher detergent tablets according to the invention are characterized in that one or more copolymers containing structural units corresponding to formula (VII):

$$-[CH_2{-}CHCOOH]_m{-}[CH_2{-}CHC(O){-}Y{-}SO_3H]_p{-} \quad \text{(VII)}$$

in which m and p are whole natural numbers of 1 to 2,000 and Y is a spacer group selected from substituted or unsubstituted aliphatic, aromatic or araliphatic hydrocarbon radicals containing 1 to 24 carbon atoms, spacer groups in which Y represents —O—$(CH_2)_n$— with n=0 to 4, —O—$(C_6H_4)$—, —NH—$C(CH_3)_2$— or —NH—$CH(CH_2CH_3)$— being preferred, is/are present in the second part.

These polymers are produced by copolymerization of acrylic acid with an acrylic acid derivative containing sulfonic acid groups. If the acrylic acid derivative containing sulfonic acid groups is copolymerized with methacrylic acid, another polymer is obtained which is also preferably used in the second part of the detergents according to the invention and which is characterized in that one or more copolymers are used which contain structural units corresponding to formula (VIII):

$$-[CH_2{-}C(CH_3)COOH]_m{-}[CH_2{-}CHC(O){-}Y{-}SO_3H]_p{-} \quad \text{(VIII)}$$

in which m and p are whole natural numbers of 1 to 2,000 and Y is a spacer group selected from substituted or unsubstituted aliphatic, aromatic or araliphatic hydrocarbon radicals containing 1 to 24 carbon atoms, spacer groups in which Y represents —O—$(CH_2)_n$— with n=0 to 4, —O—$(C_6H_4)$—, —NH—$C(CH_3)_2$— or —NH—$CH(CH_2CH_3)$— being preferred.

Entirely analogously, acrylic acid and/or methacrylic acid may also be copolymerized with methacrylic acid derivatives containing sulfonic acid groups, so that the structural units in the molecule are changed. Thus, laundry or dishwasher detergent tablets according to the invention of which the second part contains structural units corresponding to formula (IX):

$$-[CH_2{-}CHCOOH]_m{-}[CH_2{-}C(CH_3)C(O){-}Y{-}SO_3H]_p{-} \quad \text{(IX)}$$

in which m and p are whole natural numbers of 1 to 2,000 and Y is a spacer group selected from substituted or unsubstituted aliphatic, aromatic or araliphatic hydrocarbon radicals containing 1 to 24 carbon atoms, spacer groups in which Y represents —O—$(CH_2)_n$— with n=0 to 4, —O—$(C_6H_4)$—, —NH—$C(CH_3)_2$— or —NH—$CH(CH_2CH_3)$— being preferred, represent another preferred embodiment of the invention, as do laundry or dishwasher detergent tablets which are characterized in that the second part contains one or more copolymers containing structural units corresponding to formula (X):

$$-[CH_2{-}C(CH_3)COOH]_m{-}[CH_2{-}C(CH_3)C(O){-}Y{-}SO_3H]_p{-} \quad \text{(X)}$$

in which m and p are whole natural numbers of 1 to 2,000 and Y is a spacer group selected from substituted or unsubstituted aliphatic, aromatic or araliphatic hydrocarbon radicals containing 1 to 24 carbon atoms, spacer groups in which Y represents —O—$(CH_2)_n$— with n=0 to 4, —O—$(C_6H_4)$—, —NH—$C(CH_3)_2$— or —NH—$CH(CH_2CH_3)$— being preferred.

Maleic acid may also be used as a particularly preferred group i) monomer instead of or in addition to acrylic acid and/or methacrylic acid. In this way, it is possible to obtain preferred laundry or dishwasher detergent tablets according to the invention which are characterized in that one or more copolymers containing structural units corresponding to formula (XI):

$$—[HOOCCH—CHCOOH]_m—[CH_2—CHC(O)—Y—SO_3H]_p— \quad (XI)$$

in which m and p are whole natural numbers of 1 to 2,000 and Y is a spacer group selected from substituted or unsubstituted aliphatic, aromatic or araliphatic hydrocarbon radicals containing 1 to 24 carbon atoms, spacer groups in which Y represents —O—$(CH_2)_n$— with n=0 to 4, —O—$(C_6H_4)$—, —NH—$C(CH_3)_2$— or —NH—$CH(CH_2CH_3)$— being preferred, is/are present in the second part and laundry or dishwasher detergent tablets which are characterized in that the second part contains one or more copolymers containing structural units corresponding to formula (XII):

$$—[HOOCCH—CHCOOH]_m—[CH_2—C(CH_3)C(O)O—Y—SO_3H]_p— \quad (XII)$$

in which m and p are whole natural numbers of 1 to 2,000 and Y is a spacer group selected from substituted or unsubstituted aliphatic, aromatic or araliphatic hydrocarbon radicals containing 1 to 24 carbon atoms, spacer groups in which Y represents —O—$(CH_2)_n$— with n=0 to 4, —O—$(C_6H_4)$—, —NH—$C(CH_3)_2$— or —NH—$CH(CH_2CH_3)$— being preferred.

The sulfonic acid groups may be present in the polymers completely or partly in neutralized form, i.e. the acidic hydrogen atom of the sulfonic acid groups being replaceable by metal ions, preferably alkali metal ions and more particularly sodium ions, in some or all of the sulfonic acid groups. Corresponding detergents characterized in that the sulfonic acid groups in the copolymer are present in partly or fully neutralized form represent a preferred embodiment of the invention.

In the case of copolymers which only contain group i) and group ii) monomers, the monomer distribution in the copolymers present in the second part in accordance with the invention is preferably 5 to 95% by weight i) or ii) and more preferably 50 to 90% by weight group i) monomer and 10 to 50% by weight group ii) monomer, based in each case on the polymer.

Particularly preferred terpolymers contain 20 to 85% by weight group i) monomer, 10 to 60% by weight group ii) monomer and 5 to 30% by weight group iii) monomer.

The molecular weight of the polymers present in the second part in accordance with the invention may be varied in order to adapt the properties of the polymers to the particular application envisaged. Preferred detergents are characterized in that the copolymers have molecular weights of 2,000 to 200,000 $gmol^{-1}$, preferably in the range from 4,000 to 25,000 $gmol^{-1}$ and more particularly in the range from 5,000 to 15,000 $gmol^{-1}$.

Apart from the additional benefit of not having to add regenerating salt, the preferred products according to the invention described above also make the additional introduction of a rinse agent unnecessary.

The laundry or dishwasher detergent tablets according to the invention as described in the parent application, which comprise at least one cavity and contain 5 to 25% by weight of nonionic surfactant(s), based on the tablet, may also have a multiphase construction, in which case the nonionic surfactant content of the phase with the cavity is 5 to 25% by weight. Both the single-phase and the multiphase laundry or dishwasher detergent tablets according to the invention may additionally comprise a second part which is in the form of a core or a body bonded onto or into the first part ("basic tablet") and which preferably contains one or more ingredients from the group of builders, acidifying agents, chelating agents or scale-inhibiting polymers.

The polymers containing sulfonic acid groups described in the foregoing afford another additional advantage when incorporated in the laundry or dishwasher detergent tablets according to the invention. It does not matter in this connection whether the polymers containing sulfonic acid groups are present in the surfactant-rich cavity tablet ("basic tablet") itself or in another part ("core") or in both parts. However, other particular advantages can be derived from the distribution of the polymer between the two parts.

Thus, preferred dishwasher detergents according to the invention are characterized in that they contain polymers containing sulfonic acid groups in addition to the nonionic surfactants. In detergents according to this embodiment of the invention, the quantities of surfactants remaining in the machine after the main wash cycle and the intermediate rinses provide for adequate drainage behavior in the final rinse cycle so that the water draining from the tableware does not leave any stains behind after drying. The polymer containing sulfonic acid groups used also acts as an effective softener so that, even in areas with high water hardness, rinsing can be carried out with unsoftened water without any risk of deposits forming on the tableware or the machine itself. Where these detergents according to the invention are used, the final rinse cycle does not have to be charged with additional, intentionally added rinse agents, nor is there any need to use regenerating salt. Accordingly, the products described in this application for patent of addition represent genuine "3-in-1" products which combine the conventional compositions detergent, rinse agent and regenerating salt in a single composition.

Accordingly, the present invention also relates to laundry or dishwasher detergent tablets according to the invention which additionally contain 0.1 to 70% by weight of copolymers of i) unsaturated carboxylic acids, ii) monomers containing sulfonic acid groups, iii) optionally other ionic or nonionic monomers.

As mentioned at the beginning in reference to multiphase tablets, a corresponding composition of the phase with the cavity, i.e. the premix which comes into contact with the non-planar punch surface during final pressing, is sufficient. Since the first premix is only lightly compressed by the punch in pre-compression steps (for example in the production of two-layer tablets), no adhesion or edge breakages occur(s). Only during final pressing do the forces become so great that the problems mentioned are in danger of arising.

The use of sulfonated copolymers in a second part placed or stuck as "core" into the surfactant-rich cavity tablet ("basic tablet") is mentioned in the foregoing. However, the sulfonated copolymers may be incorporated not only in the "core", but also in the basic tablet and any cores present in the basic tablets may contain the copolymer(s) or may be free from them.

Irrespective of where the sulfonated copolymers are located in the laundry or dishwasher detergent tablets according to the invention, preferred laundry or dishwasher detergent tablets are characterized in that they contain the sulfonated copolymer(s) in quantities of 0.25 to 50% by weight, preferably in quantities of 0.5 to 35% by weight, more preferably in quantities of 0.75 to 20% by weight and most preferably in quantities of 1 to 15% by weight, based on the tablet as a whole.

The sulfonated copolymers are broadly described in the foregoing so that reference may be made to that description. In this case, too, generally preferred laundry or dishwasher detergent tablets are characterized in that they contain one or more copolymers containing structural units corresponding to formula III and/or IV and/or V and/or VI and/or VII and/or VIII:

$$—[CH_2—CHCOOH]_m—[CH_2—CHC(O)—Y—SO_3H]_p— \quad (VII)$$

$$—[CH_2—C(CH_3)COOH]_m—[CH_2—CHC(O)—Y—SO_3H]_p— \quad (VIII)$$

$$—[CH_2—CHCOOH]_m—[CH_2—C(CH_3)C(O)—Y—SO_3H]_p— \quad (IX)$$

$$—[CH_2—C(CH_3)COOH]_m—[CH_2—C(CH_3)C(O)—Y—SO_3H]_p— \quad (X)$$

$$—[HOOCCH—CHCOOH]_m—[CH_2—CHC(O)—Y—SO_3H]_p— \quad (XI)$$

$$—[HOOCCH—CHCOOH]_m—[CH_2—C(CH_3)C(O)O—Y—SO_3H]_p— \quad (XII)$$

in which m and p are whole natural numbers of 1 to 2,000 and Y is a spacer group selected from substituted or unsubstituted aliphatic, aromatic or araliphatic hydrocarbon radicals containing 1 to 24 carbon atoms, spacer groups in which Y represents $—O—(CH_2)_n—$ with n=0 to 4, $—O—(C_6H_4)—$, $—NH—C(CH_3)_2—$ or $—NH—CH(CH_2CH_3)—$ being preferred.

As mentioned earlier, particularly preferred monomers containing sulfonic acid groups are1 -acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxypropanesulfonic acid, allyl sulfonic acid, methallylsulfonic acid, allyloxybenzenesulfonic acid, methallyloxybenzenesulfonic acid, 2-hydroxy-3-(2-propenyloxy)-propanesulfonic acid, 2-methyl-2-propene-1-sulfonic acid, styrenesulfonic acid, vinylsulfonic acid, 3-sulfopropylacrylate, 3-sulfopropylmethacyrlate, sulfomethacrylamide, sulfomethylmethacrylamide and water-soluble salts of the acids mentioned.

It is clear from the foregoing observations that a "core" which may also contain the sulfonated copolymer(s) may be "stuck" into the surfactant-rich cavity tablet. In this case, preferred laundry or dishwasher detergent tablets are characterized in that they additionally comprise a second part which is in the form of a core or a body bonded onto or into the first part ("basic tablet") and which contains—based on the weight of the core—1 to 80% by weight, preferably 2.5 to 70% by weight, more preferably 5 to 60% by weight and most preferably 10 to 50% by weight of the sulfonated copolymer(s).

Irrespective of whether a "core" is placed or stuck into the tablets according to the invention, the tablets themselves may contain the sulfonated copolymer(s). In this case, preferred laundry or dishwasher detergent tablets are characterized in that the cavity tablet ("basic tablet") contains, based on its weight, 0.5 to 30% by weight, preferably 1 to 25% by weight, more preferably 2.5 to 20% by weight and most preferably 4 to 15% by weight of the sulfonated copolymer(s).

In a particularly preferred embodiment, a core is present and both the core and the basic tablet contain the sulfonated copolymer(s). With particular advantage, the polymer is not distributed equally between the core and the basic tablet, but is mainly located in the basic tablet. In this case, preferred laundry or dishwasher detergent tablets are characterized in that both the basic tablet and the core contain the sulfonated copolymer(s), at least 50% by weight, preferably at least 60% by weight and, more particularly, at least 65% by weight of the total of sulfonated copolymer(s) in the tablet being present in the basic tablet.

With earlier products, parts of the product had to be protected against premature release into the wash liquor by suitable measures, for example by coating, so that a controlled release of individual ingredients was achieved by those measures. Surprisingly, this is not necessary with the laundry or dishwasher detergent tablets according to the invention so that there is no need for coating either in the basic tablet or in the core (if any) to achieve a clear rinse effect and to eliminate the need for regenerating salt. Accordingly, particularly preferred laundry or dishwasher detergent tablets are characterized in that the core does not have a coating.

Besides the combination of the polymers containing sulfonic acid groups used in accordance with the invention with nonionic surfactants in large quantities, detergents according to the invention which contain other homo- and/or copolymeric polycarboxylic acids or polycarboxylates in addition to the sulfonated copolymers have proved to be particularly suitable.

Combinations of the sulfonated copolymers with heteroatom-containing polymers or copolymers, particularly those containing amino or phosphono groups, are also suitable.

In this case, particularly preferred laundry or dishwasher detergent tablets according to the invention are characterized in that they additionally contain 0.1 to 30% by weight of homo- and/or copolymeric polycarboxylic acids or salts thereof and/or heteroatom-containing polymers/copolymers, particularly those containing amino or phosphono groups.

The corresponding homo- or copolymeric polycarboxylic acids or polycarboxylates are described in detail as cobuilders in the foregoing. The combination of the two polymers in these detergents according to the invention is particularly effective because the sulfonated polymers in particular counteract phosphate-containing deposits while the carboxylate-containing polymers prevent the precipitation of calcium carbonate. In the combination, both polymer types show a synergistic effect against coatings on the tableware and the machine itself.

The combination with polymers/copolymers containing amino and/or phosphono groups is advantageous in builder systems which are only partly phosphate-based, for example phosphate/citrate mixed systems.

The two dosing steps necessary at a certain interval for operating a domestic dishwasher (after a certain number of wash cycles, the regenerating salt in the water softening system of the machine has to be replenished) can be combined into a single addition with the detergents according to the invention described in the foregoing because, even after a relatively large number of wash cycles, there is no need to add another product (regenerating salt), eliminating the need for a second dosing step.

Apart from the additional benefit of not having to add regenerating salt, the preferred products according to the invention described above also make the additional introduction of a rinse agent unnecessary.

The present invention also relates to a process for the production of laundry or dishwasher detergent tablets having at least one cavity, characterized in that a particulate premix containing 5 to 25% by weight, based on the premix, of nonionic surfactants is tabletted in known manner to form cavity tablets.

As described in detail in the foregoing in reference to multiphase/multilayer tablets, a corresponding nonionic surfactant content is sufficient for the phase/layer which is in contact during final pressing with the punch that forms the cavity. Accordingly, the present invention also relates to a process for the production of multiphase laundry or dishwasher detergent tablets having at least one cavity in which several particulate premixes are tabletted in known manner to form cavity tablets, characterized in that the premix which, in the final pressing of the tablet, is contacted with the punch for forming the cavity has a nonionic surfactant content of 5 to 25% by weight, based on the premix.

The tabletting of the single-phase or multiphase cavity tablets is carried out similarly to conventional tabletting processes except that the pressing surface of at least one punch is not flat, but has at least one protuberance which punches the cavity(ies) into the tablets according to the invention. It has proved to be of advantage if the compressed premix satisfies certain physical criteria. Preferred processes are characterized, for example, in that the particulate premix to be tabletted has a bulk density of at least 500 g/l, preferably of at least 600 g/l and more preferably of at least 700 g/l.

The particle size of the tabletted premix also preferably satisfies certain criteria. According to the invention, preferred processes are characterized in that particulate premixes have particle sizes of 100 to 2000 μm, preferably in the range from 200 to 1800 μm, more preferably in the range from 400 to 1600 μm and most preferably in the range from 600 to 1400 μm. A narrower particle size range in the premixes to be tabletted may be adjusted in order to acquire advantageous tablet properties. In preferred variants of the process according to the invention, particulate premixes to be tabletted have a particle size distribution where less than 10% by weight, preferably less than 7.5% by weight and more preferably less than 5% by weight of the particles are larger than 1600 μm or smaller than 200 μm. Narrower particle size distributions are even more preferred. Particularly advantageous variants of the process are characterized in that the particulate premixes to be tabletted have a particle size distribution where more than 30% by weight, preferably more than 40% by weight and more preferably more than 50% by weight of the particles have a particle size of 600 to 1000 μm.

So far as carrying out tabletting is concerned, the preferred process according to the invention is not confined to compressing just one particulate premix to form a tablet. Instead, this process step may also be augmented to the extent that multilayer tablets are produced in known manner by preparing two or more premixes which are pressed onto one another. In this case, the first premix introduced is lightly precompressed in order to obtain a smooth upper surface running parallel to the base of the tablet and, after the second premix has been introduced, the whole is compressed to form the final tablet. In the case of tablets with three or more layers, each addition of premix is followed by further precompression before the tablet is compressed for the last time after addition of the last premix. The above-described cavity in the basic tablet is preferably a recess so that preferred embodiments of the first process according to the invention are characterized in that multilayer tablets comprising a recess are produced in known manner by pressing several different particulate premixes onto one another. If the top punch is the non-planar punch, only the last premix has to satisfy the criteria according to the invention although it may be desirable for several or all of the premixes to contain at least 5% by weight of nonionic surfactant(s) despite otherwise different compositions.

The tablets according to the invention are produced by first dry-mixing the ingredients—which may be completely or partly pregranulated—and then shaping/forming, more particularly tabletting, the resulting mixture using conventional processes. To produce the tablets according to the invention, the premix is compacted between two punches in a die to form a solid compactate. This process, which is referred to in short hereinafter as tabletting, comprises four phases, namely metering, compacting (elastic deformation), plastic deformation and ejection.

The premix is first introduced into the die, the filling level and hence the weight and shape of the tablet formed being determined by the position of the bottom punch and the shape of the die. Uniform dosing, even at high tablet throughputs, is preferably achieved by volumetric dosing of the premix. As the tabletting process continues, the top punch comes into contact with the premix and continues descending towards the bottom punch. During this compaction phase, the particles of the premix are pressed closer together, the void volume in the filling between the punches continuously diminishing. The plastic deformation phase in which the particles coalesce and form the tablet begins from a certain position of the top punch (and hence from a certain pressure on the premix). Depending on the physical properties of the premix, its constituent particles are also partly crushed, the premix sintering at even higher pressures. As the tabletting rate increases, i.e. at high throughputs, the elastic deformation phase becomes increasingly shorter so that the tablets formed can have more or less large voids. In the final step of the tabletting process, the tablet is forced from the die by the bottom punch and carried away by following conveyors. At this stage, only the weight of the tablet is definitively established because the tablets can still change shape and size as a result of physical processes (re-elongation, crystallographic effects, cooling, etc.).

The tabletting process is carried out in commercially available tablet presses which, in principle, may be equipped with single or double punches. In the latter case, not only is the top punch used to build up pressure, the bottom punch also moves towards the top punch during the tabletting process while the top punch presses downwards. For small production volumes, it is preferred to use eccentric tablet presses in which the punch(es) is/are fixed to an eccentric disc which, in turn, is mounted on a shaft rotating at a certain speed. The movement of these punches is comparable with the operation of a conventional four-stroke engine. Tabletting can be carried out with a top punch and a bottom punch, although several punches can also be fixed to a single eccentric disc, in which case the number of die bores is correspondingly increased. The throughputs of eccentric presses vary according to type from a few hundred to at most 3,000 tablets per hour.

For larger throughputs, rotary tablet presses are generally used. In rotary tablet presses, a relatively large number of dies is arranged in a circle on a so-called die table. The number of dies varies—according to model—between 6 and 55, although even larger dies are commercially available. Top and bottom punches are associated with each die on the die table, the tabletting pressures again being actively built up not only by the top punch or bottom punch, but also by both punches. The die table and the punches move about a common vertical axis, the punches being brought into the filling, compaction, plastic deformation and ejection positions by means of curved guide rails. At those places where the punches have to be raised or lowered to a particularly significant extent (filling, compaction, ejection), these curved guide rails are supported by additional push-down members, pull-down rails and ejection paths. The die is filled from a rigidly arranged feed unit, the so-called filling shoe, which is connected to a storage container for the premix. The pressure applied to the premix can be individually adjusted through the tools for the top and bottom punches, pressure being built up by the rolling of the punch shank heads past adjustable pressure rollers.

To increase throughput, rotary presses can also be equipped with two filling shoes so that only half a circle has to be negotiated to produce a tablet. To produce two-layer or multiple-layer tablets, several filling shoes are arranged one behind the other without the lightly compacted first layer being ejected before further filling. Given suitable process control, shell and bull's-eye tablets—which have a structure resembling an onion skin—can also be produced in this way. In the case of bull's-eye tablets, the upper surface of the core or rather the core layers is not covered and thus remains visible. Rotary tablet presses can also be equipped with single or multiple punches so that, for example, an outer circle with 50 bores and an inner circle with 35 bores can be simultaneously used for tabletting. Modern rotary tablet presses have throughputs of more than one million tablets per hour.

Where rotary presses are used for tabletting, it has proved to be of advantage to carry out the tabletting process with minimal variations in the weight of the tablets. Variations in tablet hardness can also be reduced in this way. Minimal variations in weight can be achieved as follows:

- using plastic inserts with minimal thickness tolerances
- low rotor speed
- large filling shoe
- adapting the rotational speed of the filling shoe blade to the rotor speed
- filling shoe with constant powder height
- decoupling the filling shoe from the powder supply Any of the nonstick coatings known in the art may be used to reduce caking on the punch. Plastic coatings, plastic inserts or plastic punches are particularly advantageous. Rotating punches have also proved to be of advantage; if possible, the upper and lower punches should be designed for rotation. If rotating punches are used, there will generally be no need for a plastic insert. In that case, the surfaces of the punch should be electropolished.

It has also been found that long tabletting times are advantageous. These can be achieved by using pressure rails, several pressure rollers or low rotor speeds. Since variations in tablet hardness are caused by variations in the pressures applied, systems which limit the tabletting pressure should be used. Elastic punches, pneumatic compensators or spring elements in the force path may be used. The pressure roller can also be spring-mounted.

Tabletting machines suitable for the purposes of the invention can be obtained, for example, from the following companies: Apparatebau Holzwarth GbR, Asperg; Wilhelm Fette GmbH, Schwarzenbek; Hofer GmbH, Weil; Horn & Noack Pharmatechnik GmbH, Worms; IMA Verpackungssysteme GmbH Viersen; KILIAN, Cologne; KOMAGE, Kell am See, KORSCH Pressen GmbH, Berlin; and Romaco GmbH, Worms. Other suppliers are, for example Dr. Herbert Pete, Vienna (AU); Mapag Maschinenbau A G, Bern (Switzerland); B W I Manesty, Liverpool (GB); I. Holand Ltd., Nottingham (GB); and Courtoy N. V., Halle (BE/LU) and Medicopharm, Kamnik (SI). One example of a particularly suitable tabletting machine is the model HPF 630 hydraulic double-pressure press manufactured by LAEIS, D. Tabletting tools are obtainable, for example, from Adams Tablettierwerkzeuge Dresden; Wilhelm Fett GmbH, Schwarzenbek; Klaus Hammer, Solingen; Herber & Söhne GmbH, Hamburg; Hofer GmbH, Weil; Horn & Noack, Pharmatechnik GmbH, Worms; Ritter Pharmatechnik GmbH, Hamburg; Romaco GmbH, Worms and Notter Werkzeugbau, Tamm. Other suppliers are, for example, Senss A G, Reinach (CH) and Medicopharm, Kamnik (SI).

As already mentioned, the tablets can be made in certain shapes and certain sizes. Suitable shapes are virtually any easy-to-handle shapes, for example slabs, bars, cubes, squares and corresponding shapes with flat sides and, in particular, cylindrical forms of circular or oval cross-section. This last embodiment encompasses shapes from tablets to compact cylinders with a height-to-diameter ratio of more than 1.

In another possible embodiment, however, the various components are not compressed to form a single tablet, instead the tablets obtained comprise several layers, i.e. at least two layers. These various layers may have different dissolving rates. This can provide the tablets with favorable performance properties. If, for example, the tablets contain components which adversely affect one another, one component may be integrated in the more quickly dissolving layer while the other component may be incorporated in a more slowly dissolving layer so that the first component can already have reacted off by the time the second component dissolves. The various layers of the tablets can be arranged in the form of a stack, in which case the inner layer(s) dissolve at the edges of the tablet before the outer layers have completely dissolved. Alternatively, however, the inner layer(s) may also be completely surrounded by the layers lying further to the outside which prevents constituents of the inner layer(s) from dissolving prematurely.

In another preferred embodiment of the invention, a tablet consists of at least three layers, i.e. two outer layers and at least one inner layer, a peroxy bleaching agent being present in at least one of the inner layers whereas, in the case of the stack-like tablet, the two cover layers and, in the case of the envelope-like tablet, the outermost layers are free from peroxy bleaching agent. In another possible embodiment, peroxy bleaching agent and any bleach activators or bleach catalysts present and/or enzymes may be spatially separated from one another in one and the same tablet.

After pressing, the laundry or dishwasher detergent tablets have high stability. The fracture resistance of cylindrical tablets can be determined via the diametral fracture stress. This in turn can be determined in accordance with the following equation:

$$\sigma = \frac{2P}{\pi Dt}$$

where σ represents the diametral fracture stress (DFS) in Pa, P is the force in N which leads to the pressure applied to the tablet that results in fracture thereof, D is the diameter of the tablet in meters and t is its height.

The laundry/detergent tablets according to the invention may be packed after their production, the use of certain packaging systems having proved to be particularly effective because, on the one hand, such systems increase the shelf life of the ingredients and, on the other hand, suprisingly promote a distinct improvement in the long-term adhesion of the cavity filling of cavity tablets with an inserted second part. Accordingly, the present invention also relates to a combination of (one or more) laundry/diswasher detergent tablet(s) according to the invention and a packaging system containing the tablet(s), characterized in that the packaging system has a water vapor transmission rate of 0.1 $g/m^2/day$ to less than 20 $g/m^2/day$ when it is stored at 23° C./85% relative equilibrium humidity.

According to the invention, the packaging system of the laundry or dishwasher detergent tablet(s)/packaging system combination has a water vapor transmission rate of 0.1 $g/m^2/day$ to less than 20 $g/m^2/day$ when the packaging system is stored at 23° C./85% relative equilibrium humidity. The temperature and humidity conditions mentioned are the test conditions specified in DIN 53122, according to which minimal deviations are acceptable (23±1° C., 85±2% relative humidity). The water vapor transmission rate of a given packaging system or material can be determined by other standard methods and is also described, for example, in ASTM Standard E-96-53T ("Test for Measuring Water Vapor Transmission of Materials in Sheet Form") and in TAPPI standard T464 m-45 ("Water Vapor Permeability of Sheet Materials at High Temperatures and Humidity"). The measurement principle of standard methods is based on the water absorption of anhydrous calcium chloride which is stored in a container in the corresponding atmosphere, the container being closed on top by the material to be tested. The water vapor transmission rate can be calculated from the surface of the container closed by the material to be tested (permeation surface), the increase in weight of the calcium chloride and the exposure time in accordance with the following equation:

$$WVTR = \frac{24 \cdot 10000}{A} \cdot \frac{x}{y} [g/m^2/24h]$$

where A is the surface area of the material to be tested in $cm^2$, x is the increase in weight of the calcium chloride in g and y is the exposure time in h.

The relative equilibrium humidity, often referred to as "relative air humidity", in the measurement of the water vapor transmission rate for the purposes of the present invention is 85% at 23° C. The absorption capacity of air for water vapor increases with temperature to a particular maximum content, the so-called saturation content, and is expressed in $g/m^3$. For example, 1 $m^3$ of air at 17° is saturated with 14.4 g of water vapor, the saturation content at 11° being as much as 10 g of water vapor. The relative air humidity is the ratio expressed in percent between the water vapor content actually present and the saturation content corresponding to the prevailing temperature. If, for example, air at 17° contains 12 $g/m^3$ water vapor, the relative air humidity is (12/14.4)·100=83%. If this air is cooled, saturation (100% relative humidity) is reached at the so-called dew point (in the example 14°), i.e. a deposit in the form of mist (dew) is formed with further cooling. Hygrometers and psychrometers are used for the quantitative determination of humidity.

The relative equilibrium humidity of 85% at 23° C. can be adjusted to an accuracy of ±2% relative humidity (depending on the instrument used), for example in humidity-controlled laboratory chambers. Oversaturated solutions of certain salts also form constant and well-defined relative air humidities at a given temperature in closed systems, these relative air humidities being based on the phase equilibrium between the partial pressure of the water, the saturated solution and the sediment.

The combinations according to the invention of laundry or dishwasher detergents and packaging system may of course themselves be packed in secondary packs, for example cardboard boxes or trays, the secondary pack having to meet no other requirements. Accordingly, the secondary pack is possible, but not necessary.

Preferred packaging systems according to the invention have a water vapor transmission rate of 0.5 $g/m^2/day$ to less than 15 $g/m^2/day$.

The packaging system of the combination according to the invention surrounds one or more laundry or dishwasher detergent tablets, depending on the embodiment of the invention. In one preferred embodiment of the invention, a tablet may be made up in such a way that it constitutes a dose or dosage unit of the laundry or dishwasher detergent and may be individually packed or tablets may be packed in a packaging unit in numbers which, together, constitute a dose or dosage unit. Accordingly, for a prescribed dose of 80 g of detergent, it is possible in accordance with the invention to produce and individually pack a detergent tablet weighing 80 g. However, it is also possible in accordance with the invention to pack two detergent tablets each weighing 40 g in one pack in order to obtain a combination according to the invention. This principle may of course also be extended so that, according to the invention, combinations of three, four, five or even more detergent tablets may be accommodated in one and the same packaging unit. Two or more tablets in the same pack may of course have different compositions. In this way, certain components can be spatially separated from one another in order, for example, to avoid stability problems.

The packaging system of the combination according to the invention may consist of various materials and may assume various external forms. For economic reasons and in the interests of easier processability, however, preferred packaging systems are those in which the packaging material is light in weight, easy to process and inexpensive. In preferred combinations according to the invention, the packaging consists of a bag of single-layer or laminated paper and/or plastic film.

The laundry or dishwasher detergent tablets may be introduced without sorting, i.e. loosely, into a bag of the materials mentioned above. However, for aesthetic reasons and for sorting the combinations in secondary packs, bags are preferably filled either with single tablets or with several tablets in sorted form. The term "flow pack" is now commonly used for individual dosage units of the laundry or dishwasher detergent tablets accommodated in a bag. Flow packs may optionally be packed—again preferably sorted—in outer packs which underscores the compact supply form of detergent tablets.

The bags of single-layer or laminated paper or plastic film preferably used as the packaging system may be designed in various ways, for example as inflated bags with no center seam or as bags with a center seam which are closed by heat (heat sealing), adhesives or adhesive tape. Single-layer bag materials are the known papers, which may optionally be impregnated, and plastic films which may optionally be co-extruded. Plastic films which may be used as the packaging system in accordance with the invention are described, for example, in Hans Domininghaus "Die Kunststoffe und ihre Eigenschaften" 3rd Edition, VDI Verlag, Düsseldorf, 1988, page 193. FIG. 111 of this publication also provides reference points in respect of the water vapor transmission of the materials mentioned.

Particularly preferred combinations according to the invention contain a bag of single-layer or laminated plastic film with a thickness of 10 to 200 μm, preferably 20 to 100 μm and more preferably 25 to 50 μm as the packaging system.

Although wax-coated papers in the form of paperboard articles may also be used in addition to the films or papers mentioned as the packaging system for the laundry/detergent tablets according to the invention, the packaging system preferably does not comprise any wax-coated paper. The term "packaging system" in the context of the present invention always characterizes the primary pack of the tablets, i.e. the pack which is in direct contact with the surface of the tablets on its inside. An optional secondary pack does not have to meet any requirements so that any of the usual materials and systems may be used.

As mentioned earlier on, the laundry or dishwasher detergent tablets of the combination according to the invention contain other ingredients of laundry or dishwasher detergents in varying quantities, depending on the application envisaged. Irrespective of the application envisaged for the tablets, it is preferred in accordance with the invention for the laundry or dishwasher detergent tablets to have a relative equilibrium moisture content of less than 30% at 35° C.

The relative equilibrium moisture content of the laundry or dishwasher detergent tablets may be determined by standard methods. The following procedure was selected for the present investigations: a water-impermeable 1-liter vessel with a cover having a closable opening for the insertion of samples was filled with a total of 300 g of laundry or dishwasherdetergent tablets and kept at a constant temperature of 23° C. for 24 hours in order to guarantee the vessel and the substance a uniform temperature. The water vapor pressure in the space above the tablets can then be determined with a hygrometer (Hygrotest 6100, Testoterm Ltd., England). The water vapor pressure is measured every 10 minutes until two successive values show no deviation (equilibrium moisture content). The hygrometer mentioned above enables the values recorded to be directly displayed in % relative moisture.

Embodiments of the combination according to the invention in which the packaging system is re-closable are also preferred. Combinations in which the pack has a microperforation can also be produced with advantage in accordance with the invention.

The compositions according to the invention may be used in any domestic dishwashing machine with no restrictions on the choice of program. The advantageous effects are obtained both in low-temperature programs, such as 45° C. programs or glass programs, and in 50/55° C. or 60/65° C. programs.

Accordingly, the present invention also relates to a method for cleaning tableware in a domestic dishwashing machine in which one or more detergent tablet(s) according to the invention is/are introduced into the main wash cycle of the machine.

The tablet(s) may be introduced into the main wash cycle by filling the dispensing compartment with the tablet(s), the tablet(s) being released into the machine by opening of the dispensing compartment, optionally after a prewash cycle. Alternatively, the tablets may be directly introduced into the machine and active substance thus released in an optional prewash cycle. Alternatively, the prewash cycle may be omitted. By virtue of the detergents according to the invention, no additional rinse agent need be added in the final rinse cycle so that methods according to the invention where the final rinse cycle of the machine takes place without the intentional addition of other rinse agents are preferred.

The expression "other rinse agents" encompasses liquid commercially available rinse agents which have to be placed in a storage container in the machine by the user at intervals of several wash cycles and released from that container under program control. The need for this intentional addition of a rinse agent and the second dosing step it involves at intervals of a few wash cycles is eliminated by the use of the detergents according to the invention.

The present invention also relates to a process for cleaning tableware in a domestic dishwashing machine using detergent tablets, characterized in that it comprises the steps of a) contacting the soiled tableware with an aqueous cleaning liquor of water and detergent tablets, the detergent tablets containing 5 to 25% by weight of nonionic surfactant(s),
b) pumping off the cleaning liquor and subjecting the tableware to a final rinse cycle.

As already mentioned, the advantages of the present invention are also obtained when the main wash cycle and the final rinse cycle are interrupted by intermediate rinses. Accordingly, preferred processes are characterized in that one or more intermediate rinse cycles take place between steps a) and b).

In this case, too, there is no need for the additional intentional addition of commercially available rinse agents so that processes where no other rinse agent is intentionally added in step b) are preferred.

Entirely analogously, washing processes according to the invention for washing textiles in domestic washing machines are further subjects of the present invention. These processes are carried out using laundry detergent tablets according to the invention instead of dishwasher tablets according to the invention.

The invention claimed is:

1. A laundry or dishwasher detergent tablet having at least one cavity, said cavity having a base and lateral boundary walls, said tablet comprising 5.5% to 25% by weight, based on the tablet, of one or more nonionic surfactants with a melting point above 20° C., wherein the cavity base and lateral boundary walls form a non-orthogonal angle greater than 90° further comprising 0.1% to 70% by weight of copolymers of i) unsaturated carboxylic acids;
ii) monomers containing sulfonic acid groups; and
iii) optionally other ionic or nonionic monomers, wherein the copolymers comprises structural units corresponding to formulae VII, VIII, IX, X, XI and/or XII:

$$—[CH_2—CHCOOH]_m—[CH_2—CHC(O)—Y—SO_3H]_p— \quad (VII)$$

$$—[CH_2—C(CH_3)COOH]_m—[CH_2—CHC(O)—Y—SO_3H]_p— \quad (VIII)$$

$$—[CH_2—CHCOOH]_m—[CH_2—C(CH_3)C(O)—Y—SO_3H]_p— \quad (IX)$$

$$—[CH_2—C(CH_3)COOH]_m—[CH_2—C(CH_3)C(O)—Y—SO_3H]_p— \quad (X)$$

$$—[HOOHCCH—CHCOOH]_m—[CH_2—CHC(O)—Y—SO_3H]_p— \quad (XI)$$

$$—[HOOCCH—CHCOOH]_m—[CH_2—C(CH_3)C(O)O—Y—SO_3H]_p— \quad (XII)$$

in which m and p are whole natural numbers of 1 to 2,000 and Y is a spacer group selected from substituted or unsubstituted aliphatic, aromatic or araliphatic hydrocarbon radicals containing 1 to 24 carbon atoms.

2. The tablet of claim 1, wherein the tablet has more than one phase.

3. The tablet of claim 1, wherein the cavity occupies 1% to 25% of the total surface area of the tablet.

4. The tablet of claim 3, wherein the cavity occupies 2% to 20% of the total surface area of the tablet.

5. The tablet of claim 4, wherein the cavity occupies 3% to 15% of the total surface area of the tablet.

6. The tablet of claim 1, wherein the cavity occupies 4% to 10% of the total surface area of the tablet.

7. The tablet of claim 1, wherein the one or more nonionic surfactant have a melting point above 25° C.

8. The tablet of claim 7, wherein the one or more nonionic surfactant have a melting point of between 25° C. and 60° C.

9. The tablet of claim 7, wherein the one or more nonionic surfactant have a melting point of between 26.6° C. and 43.3° C.

10. The tablet of claim 1, comprising 6% to 17.5% by weight of the one or more non-ionic surfactants.

11. The tablet of claim 10, comprising 6.5% to 15% by weight of the one or more non-ionic surfactants.

12. The tablet of claim 11, comprising 7% to 12.5% by weight of the one or more non-ionic surfactants.

13. The tablet of claim 1, wherein the one or more nonionic surfactants comprise ethoxylated nonionic surfactants obtained from $C_{6-20}$ monohydroxyalkanols, $C_{6-20}$ alkylphenols, or $C_{16-20}$ fatty alcohols and more than 12 moles ethylene oxide per mole alcohol.

14. The tablet of claim 13, wherein the one or more nonionic surfactants comprise ethoxylated nonionic surfactants obtained from $C_{6-20}$ monohydroxyalkanols, $C_{6-20}$ alkylphenols, or $C_{16-20}$ fatty alcohols and more than 15 moles ethylene oxide per mole alcohol.

15. The tablet of claim 14, wherein the one or more nonionic surfactants comprise ethoxylated nonionic surfactants obtained from $C_{6-20}$ monohydroxyalkanols, $C_{6-20}$ alkylphenols, or $C_{16-20}$ fatty alcohols and more than 20 moles ethylene oxide per mole alcohol.

16. The detergent tablet of claim 1, comprising one or more ethoxylated and propoxylated nonionic surfactants, in which propoxylated nonionic surfactants the propylene oxide units in the molecule make up as much as 25% by weight of the total molecular weight of the surfactant.

17. The detergent tablet of claim 16, wherein in the propoxylated nonionic surfactants the propylene oxide units in the molecule make up as much as 20% by weight of the total molecular weight of the surfactant.

18. The detergent tablet of claim 17, wherein in the propoxylated nonionic surfactants the propylene oxide units in the molecule make up as much as 15% by weight of the total molecular weight of the surfactant.

19. The detergent tablet of claim 1, comprising one or more nonionic surfactants of the formula:

$$R^1O[CH_2CH(CH_3)O]_x[CH_2CH_2O]_y[CH_2CH(OH)R^2]$$

in which $R^1$ is a linear or branched aliphatic hydrocarbon radical containing 4 to 18 carbon atoms or mixtures thereof, $R^2$ is a linear or branched hydrocarbon radical containing 2 to 26 carbon atoms or mixtures thereof, x has a value of 0.5 to 1.5, and y has a value of at least 15.

20. The detergent tablet of claim 1, comprising one or more end-capped poly(oxyalkylated) nonionic surfactants of the formula:

$$R^1O[CH_2CH(R^3)O]_x[CH_2]_kCH(OH)[CH_2]_jOR^2$$

in which $R^1$ and $R^2$ are linear or branched, saturated or unsaturated, aliphatic or aromatic hydrocarbon radicals containing 1 to 30 carbon atoms, $R^3$ stands for H or for a methyl, ethyl, n-propyl, isopropyl, n-butyl, 2-butyl or 2-methyl-2-butyl radical, x has a value of 1 to 30, k and j have values of 1 to 12 and preferably 1 to 5, or surfactants of the formula:

$$R^1O[CH_2CH(R^3)O]_xCH_2CH(OH)CH_2OR^2$$

in which x is a number of 1 to 30.

21. The detergent tablet of claim 20, wherein x is a number of 1 to 20.

22. The detergent tablet of claim 21, wherein x is a number of 6 to 18.

23. The detergent tablet of claim 1, comprising:

a) 1.0% to 4.0% by weight of one or more alkoxylated alcohol nonionic surfactants; and b) 4.0% to 24.0% by weight of hydroxyfunctional alkoxylated alcohol nonionic surfactants, based on the tablet as a whole or on a phase within the cavity.

24. The detergent tablet of claim 23, comprising:

a) 1.5% to 3.5% by weight of one or more alkoxylated alcohol nonionic surfactants; and b) 4.5% to 20.0% by weight of hydroxyfunctional alkoxylated alcohol nonionic surfactants, based on the tablet as a whole or on a phase within the cavity.

25. The detergent tablet of claim 24 , comprising:

a) 1.75% to 3.0% by weight of one or more alkoxylated alcohol nonionic surfactants; and b) 5.0% to 15.0% by weight of hydroxyfunctional alkoxylated alcohol nonionic surfactants, based on the tablet as a whole or on a phase within the cavity.

26. The detergent tablet of claim 1, comprising:

a) 2.0% to 2.5% by weight of one or more alkoxylated alcohol nonionic surfactants; and b) 7.0% to 10.0% by weight of hydroxyfunctional alkoxylated alcohol nonionic surfactants, based on the tablet as a whole or on a phase within the cavity.

27. The detergent tablet of claim 1, further comprising a part in the form of a core or a body bonded onto or into the tablet.

28. The detergent tablet of claim 27, wherein the core or body bonded onto or into the tablet comprises one or more substances selected from the group consisting of builders, acidifying agents, chelating agents, and scale-inhibiting polymers.

29. The detergent tablet of claim 1, comprising 2.5% to 70% by weight of the sulfonated copolymers.

30. The detergent tablet of claim 1, comprising 0.25% to 50% by weight of the sulfonated copolymers.

31. The detergent tablet of claim 30, comprising 0.5% to 35% by weight of the sulfonated copolymers.

32. The detergent tablet of claim 31, comprising 0.75% to 20% by weight of the sulfonated copolymers.

33. The detergent tablet of claim 32, comprising 1% to 15% by weight of the sulfonated copolymers.

34. The detergent tablet of claim 1, copolymers containing structural units corresponding to formulae VII, VIII, IX, X, XI and XII:

$$—[CH_2—CHCOOH]_m—[CH_2—CHC(O)—Y—SO_3H]_p— \quad (VII)$$

$$—[CH_2—C(CH_3)COOH]_m—[CH_2—CHC(O)—Y—SO_3H]_p— \quad (VIII)$$

$$—[CH_2—CHCOOH]_m—[CH_2—C(CH_3)C(O)—Y—SO_3H]_p— \quad (IX)$$

$$—[CH_2—C(CH_3)COOH]_m—[CH_2—C(CH_3)C(O)—Y—SO_3H]_p— \quad (X)$$

$$—[HOOHCCH—CHCOOH]_m—[CH_2—CHC(O)—Y—SO_3H]_p— \quad (XI)$$

$$—[HOOCCH—CHCOOH]_m—[CH_2—C(CH_3)C(O)O—Y—SO_3H]_p— \quad (XII)$$

in which m and p are whole natural numbers of 1 to 2,000 and Y is a spacer group selected from substituted or unsubstituted aliphatic, aromatic or araliphatic hydrocarbon radicals wherein Y represents $O—(CH_2)_n—$ with n=0 to 4, $—O—(C_6H_4)—$, $—NH—C(CH_3)_2—$, or $—NH—CH(CH_2CH_3)—$.

35. The detergent tablet of claim 34, comprising a part which in the form of a core or a body bonded onto or into the tablet, said core or body comprising, based on its weight, 1% to 80% by weight of the sulfonated copolymers.

36. The detergent tablet of claim 34, comprising a part which in the form of a core or a body bonded onto or into the tablet, said core or body comprising, based on its weight, 2.5% to 70% by weight of the sulfonated copolymers.

37. The detergent tablet of claim 34, comprising a part which in the form of a core or a body bonded onto or into the tablet, said core or body comprising, based on its weight, 5% to 60% by weight of the sulfonated copolymers.

38. The detergent tablet of claim 34, comprising a part which in the form of a core or a body bonded onto or into the tablet, said core or body comprising, based on its weight, 10% to 50% by weight of the sulfonated copolymers.

39. The detergent tablet of claim 34, wherein the tablet apart from the core or body bonded onto or into it comprises, based on its weight, 0.5% to 30% by weight of the sulfonated copolymers.

40. The detergent tablet of claim 34, wherein the tablet apart from the core or body bonded onto or into it comprises, based on its weight, 1% to 25% by weight of the sulfonated copolymers.

41. The detergent tablet of claim 34, wherein the tablet apart from the core or body bonded onto or into it comprises, based on its weight, 2.5% to 20% by weight of the sulfonated copolymers.

42. The detergent tablet of claim 34, wherein the tablet apart from the core or body bonded onto or into it comprises, based on its weight, 4.0% to 15% by weight of the sulfonated copolymers.

43. The detergent tablet of claim 40, wherein the tablet apart from the core or body bonded onto or into it comprises at least 50% by weight of the total of sulfonated copolymers in the tablet.

44. The detergent tablet of claim 43, wherein the tablet apart from the core or body bonded onto or into it comprises at least 60% by weight of the total of sulfonated copolymers in the tablet.

45. The detergent tablet of claim 44, wherein the tablet apart from the core or body bonded onto or into it comprises at least 65% by weight of the total of sulfonated copolymers in the tablet.

46. The detergent tablet of claim 34, wherein the core or body bonded onto or into the tablet does not have a coating.

47. The tablet of claim 1, further comprising 0.1% to 30% by weight of either or both homo- and/or copolymeric polycarboxylic acids or salts thereof and heteroatom-containing polymers or copolymers.

48. The tablet of claim 47, wherein the heteroatom-containing polymers or copolymers comprise either or both of amino or phosphono groups.

49. The tablet of claim 1, further comprising 0.1% to 30% by weight of polymers or copolymers containing amino or phosphono groups.

50. The tablet of claim 1, wherein the cavity base and lateral boundary walls form a non-orthogonal angle between 90° and 120°.

51. The tablet of claim 50, wherein the cavity base and lateral boundary walls form a non-orthogonal angle between 91° and 110°.

52. The tablet of claim 51, wherein the cavity base and lateral boundary walls form a non-orthogonal angle between 92° and 100°.

53. The tablet of claim 52, wherein the cavity base and lateral boundary walls form a non-orthogonal angle between 93° and 98°.

* * * * *